United States Patent [19]

Ikeda et al.

[11] Patent Number: 4,894,319

[45] Date of Patent: Jan. 16, 1990

[54] COLOR IMAGE-FORMING PROCESS FOR HIGH SILVER CHLORIDE COLOR PHOTOGRAPHIC MATERIAL HAVING IMPROVED SPECTRAL SENSITIVITY AND SILVER REMOVABILITY

[75] Inventors: Tadashi Ikeda; Tadashi Ogawa; Masaki Okazaki, all of Kanagawa, Japan

[73] Assignee: Fuji Photo Film Co., Ltd., Kanagawa, Japan

[21] Appl. No.: 271,988

[22] Filed: Nov. 16, 1988

Related U.S. Application Data

[62] Division of Ser. No. 59,669, Jun. 8, 1987, Pat. No. 4,837,140.

[30] Foreign Application Priority Data

Jun. 6, 1986 [JP] Japan ..... 61-131583

[51] Int. Cl.[4] ..... G03C 7/16

[52] U.S. Cl. ..... 430/383; 430/374; 430/376; 430/430; 430/556; 430/567; 430/574

[58] Field of Search ..... 430/400, 430, 455, 460, 430/505, 550, 556, 567, 569, 572, 574, 577, 583, 591, 374, 376, 383

[56] References Cited

U.S. PATENT DOCUMENTS

| | | | |
|---|---|---|---|
| 4,469,785 | 9/1984 | Tanaka et al. | 430/550 |
| 4,552,837 | 11/1985 | Okazaki et al. | 430/550 |
| 4,564,591 | 1/1986 | Tanaka et al. | 430/567 |
| 4,581,327 | 4/1986 | Habu et al. | 430/567 |
| 4,581,329 | 4/1986 | Sugimoto et al. | 430/567 |
| 4,621,041 | 11/1986 | Saikawa et al. | 430/567 |
| 4,640,890 | 2/1987 | Fujita et al. | 430/567 |
| 4,675,279 | 6/1987 | Shuto et al. | 430/550 |

*Primary Examiner*—Hoa Van Le

*Attorney, Agent, or Firm*—Sughrue, Mion, Zinn, Macpeak & Seas

[57] ABSTRACT

A color image-forming process is disclosed, which comprises imagewise exposing a silver halide color photographic material comprising a support having thereon at least one light-sensitive layer containing at least one coupler capable of forming a dye upon a reaction with an oxidation product of an aromatic primary amine color developing agent and a silver halide emulsion spectrally sensitized with a dye represented by the following general formula (I), (II) or (II), substantially excluding silver iodide, and containing about 80 mol % or more silver chloride, processing the exposed photographic material with a color developer, then processing it with a solution having a pH of not more than about 6.5 and having a bleaching ability within about 75 seconds:

(I)

(II)

(III)

wherein the symbols have the meanings described hereinafter.

A silver halide color photographic material to be processed in accordance with the method described above is also disclosed.

21 Claims, No Drawings

COLOR IMAGE-FORMING PROCESS FOR HIGH SILVER CHLORIDE COLOR PHOTOGRAPHIC MATERIAL HAVING IMPROVED SPECTRAL SENSITIVITY AND SILVER REMOVABILITY

This is a division of Ser. No. 059,669, filed 6/8/87, now U.S. Pat. No. 4,837,140.

FIELD OF THE INVENTION

The present invention relates to a color image-forming process and, more particularly, to a color image-forming process which provides a high sensitivity, an improved fog resistance, and an improved silver removability, and which is capable of undergoing rapid processing. In addition, the present invention relates to a silver halide color photographic material suitable for use in the above-described image-forming process.

BACKGROUND OF THE INVENTION

Recently, in the photographic market there has been an increasing requirement for rapid photographic processing, and it has become extremely important to meet this requirement.

Silver halide mainly containing silver bromide and having been predominantly used in the past are disadvantageous in principle with respect to rapid processing, since bromide ion to be released upon development of silver bromide has development-inhibiting properties. Thus, from the standpoint of achieving rapid processing, the use of silver halides mainly containing silver chloride is preferable.

So-called "high silver chloride emulsions" containing a high proportion of silver chloride are advantageous in view of attaining suitable rapid processing.

It has been found, however, that the use of high silver chloride emulsions involves the following disadvantage in accelerating photographic processing. That is, though high silver chloride emulsions undergo rapid fixing during a silver-removing step, silver deposit produced as a result of development is much more difficult to bleach than silver deposit produced from low silver chloride emulsions. It has become apparent that this is disadvantageous not only in the case of accelerating and shortening photographic processing, including the silver-removing step, but also in the case of coping with the bleaching difficulty by prolonging the silver-removing time. This is because, in the latter case, the prolonged silver-removing time sometimes negates the shortened or accelerated photographic processing time.

In the bleaching step, a combination of a bleaching bath and a fixing bath or a bleach-fixing bath is used. Suitable bleaching agents to be used in the bleach-fixing bath include organic iron chelating agents, such as iron aminopolycarboxylates showing a moderate oxidizing power not affecting a coexisting fixing agent, such as a silver halide solvent. It has been found that such bleach-fixing baths not having a strong oxidizing power undergo a reduction in oxidizing power particularly when fatigued after processing a large amount of silver halide photographic materials, or when the amount of processing solution used in the foregoing step is increased so that bleaching of silver deposits is delayed and, in an extreme case, a portion of silver deposits can hardly be removed, even by indefinitely prolonged the bleaching time.

In addition, shortening of the exposure time is also important in terms of decreasing the entire photographic processing time, thus improving productivity. Therefore, emulsions to be used must be highly sensitive. However, high silver chloride emulsions are known to have the defect that they easily form fog and possess a low sensitivity, although they can be rapidly developed. Further, intrinsic absorption of the high silver chloride grains occurs in a short wavelength regions; hence, the grains show an extremely weak absorption of visible light in comparison with silver halide grains comprising mainly silver bromide. Particularly, high silver chloride grains containing 99 mol % or more silver chloride are known to scarcely absorb visible light. In order to render silver halide responsive to light in longer wavelength regions than the silver halide-intrinsic absorption region, spectral sensitizing techniques are commonly employed. However, as is different from silver halide emulsions comprising mainly silver bromide, high silver chloride emulsions require spectral sensitization even when used as an emulsion sensitive to light of the blue region. These facts have long been known. Various spectral sensitizing dyes have recently been proposed in Japanese patent application (OPI) Nos. 106,538/83, 107,531/83 and 107,532/83 (U.S. Patent No. 4,469,785); Nos. 107,533/83, 91,444/83; No.95,339/83 (U.S. Patent No. 4,517,284), etc. (the term "OPI" as used herein means an "unexamined published application"). As is different from emulsions comprising mainly silver bromide, high silver chloride emulsions show very poor spectral sensitizing properties, even when subjected to spectral sensitization. For example, the spectral sensitizing agents described in the above-mentioned specifications, which are usually used for emulsions comprising mainly silver bromide and show high sensitizing ability therefor, do not necessarily show high sensitizing ability for high silver chloride emulsions. Further, with respect to spectral sensitizing agents other than those for used for sensitizing emulsions to blue light, many of these spectral sensitizing agents which are effective for emulsions comprising mainly silver bromide have been found to exhibit low sensitizing ability for high silver chloride emulsions. Still further, it has been found that many of the spectral sensitizing agents described in the aforesaid specifications and spectral sensitizing agents used usually for silver halide emulsions comprising mainly silver bromide seriously inhibit bleaching of silver deposits formed in high silver chloride emulsions.

Bleaching of silver deposits depends not only upon the oxidizing power of the bleaching solution, but also upon the shape or form of the silver deposits or the amount of silver deposited. Bleaching difficulty of the silver deposits produced from high silver chloride emulsions in comparison with that from low silver chloride emulsions in attributed to the difference in the shape of silver deposits based on observation of these silver deposits using an electron microscope.

More importantly, bleaching of silver deposits can be delayed or inhibited by some compounds absorbed on the surface of the silver deposits. Silver halide color photographic materials are designed to exert various steps of development processing, from imagewise exposure to development and color formation, and various compounds are incorporated therein for performing such functions. It is important not to cause the aforesaid inhibition of silver removal while meeting these requirements.

It has been observed that the inhibition of removal of silver deposits formed from high silver chloride emulsions is also caused by bromide ion which is usually added to a color developer for assuring uniform development. This bromide ion is considered to change the shape or form of silver deposits.

SUMMARY OF THE INVENTION

As a result of various investigations, the present inventors have found that the dyes represented by the general formula (I), (II) or (III) described hereinafter show high special sensitizing ability for high silver chloride emulsions.

Of these compounds, cyanine dyes particularly show excellent J-association product-forming ability, including so-called J-band type spectral sensitizing ability for high silver chloride emulsions containing 95 mol % or more silver chloride and show excellent absorptive properties on the high silver chloride grains and high spectral sensitizing ability.

However, these dyes also strongly absorb on silver deposits produced from the high silver chloride emulsion, and inhibition of silver removal is observed during ordinary bleaching.

Therefore, an object of the present invention is to provide a light-sensitive color photographic material containing a high silver chloride emulsion and having high spectral sensitivity.

A further object of the present invention is to provide a color image-forming process capable of rapidly bleaching silver deposits formed during color development of the light-sensitive color photographic material.

These and other objects have been attained by an accelerated color image-forming process which comprises imagewise exposing and subsequently processing a silver halide color photographic material with a color developer preferably substantially excluding benzyl alcohol and containing up to about 0.002 mol/liter of bromide ion, with the developing time being not longer than 2 minutes and 30 seconds), then processing the silver halide color photographic material in a solution having of pH of not more than about 6.5 having a bleaching ability (bleach-fixing solution or bleaching solution) for a time of not longer than about 75 seconds, said silver halide photographic material comprising a support having thereon at least one light-sensitive layer containing at least one coupler capable of forming a dye upon a coupling reaction with an oxidation product of an aromatic primary amine color developing agent and a silver halide emulsion substantially excluding silver iodide and containing about 80 mol % or more, preferably 90% or more, silver chloride and further containing at least one of the compounds represented by general formula (I), (II) or (III) described in detail below.

DETAILED DESCRIPTION OF THE INVENTION

Sensitizing dyes represented by general formula (I) are as follows:

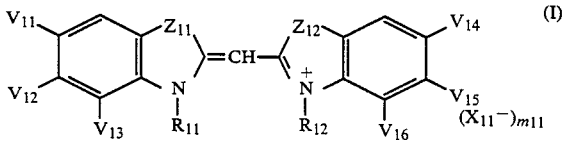

(I)

In the above general formula (I), $Z_{11}$ represents an oxygen atom, a sulfur atom or a selenium atom.

$Z_{12}$ represents a sulfur atom or a selenium atom.

$R_{11}$ and $R_{12}$ which may be the same or different, each represents an optionally substituted alkyl group or alkenyl group containing up to 6 carbon atoms, with at least one of $R_{11}$ and $R_{12}$ being a sulfo-substituted alkyl group. Most preferably, at least one of $R_{11}$ and $R_{12}$ represents a 3-sulfopropyl group, a 2-hydroxy-2-sulfopropyl group, a 3-sulfobutyl group, or a sulfoethyl group. Examples of suitable substituents include an alkoxy group containing up to 4 carbon atoms, a halogen atom, a hydroxy group, a carbamoyl group, a phenyl group which may be optionally substituted and which contains up to 8 carbon atoms, a carboxy group, a sulfo group, and an alkoxycarbonyl group containing up to 5 carbon atoms. Specific examples of $R_{11}$ and $R_{12}$ include a methyl group, an ethyl group, a propyl group, an allyl group, a pentyl group, a hexyl group, a methoxyethyl group, an ethoxyethyl group, a phenethyl group, a 2-p-tolylethyl group, a 2-p-sulfophenethyl group, a 2,2,2-trifluoroethyl group, a 2,2,3-tetrafluoropropyl group, a carbamoylethyl group, a hydroxyethyl group, a 2-(2-hydroxyethoxy)ethyl group, a carboxymethyl group, a carboxyethyl group, an ethoxycarbonylmethyl group, a 2-sulfoethyl group, a 2-chloro-3-sulfopropyl group, a 3-sulfopropyl group, a 2-hydroxy-3-sulfopropyl group, a 3-sulfobutyl group, a 4-sulfobutyl group, etc.

When $Z_{11}$ represents an oxygen atom, $V_{11}$ and $V_{13}$ each represents a hydrogen atom, and $V_{12}$ represents a phenyl group or a phenyl group substituted by an alkyl group or an alkoxy group containing up to 3 carbon atoms or a chlorine atom (particularly preferably a phenyl group), or $V_{11}$ and $V_{12}$, or $V_{12}$ and $V_{13}$, may be linked to each other to form a fused benzene ring. Most preferably, $V_{11}$ and $V_{13}$ each represents a hydrogen atom, and $V_{12}$ represents a phenyl group.

When $Z_{11}$ represents a sulfur atom or a selenium atom, $V_{11}$ represents an alkyl group containing up to 4 carbon atoms or a hydrogen atom, $V_{12}$ represents an alkyl group containing up to 5 carbon atoms, an alkoxy group containing up to 4 carbon atoms, a chlorine atom, a hydrogen atom, an optionally substituted phenyl group (e.g., a tolyl group, an anisyl group, a phenyl group, etc.) or a hydroxy group, and $V_{13}$ represents a hydrogen atom, or $V_{11}$ and $V_{12}$, or $V_{12}$ and $V_{13}$, may be linked to each other to form fused benzene ring. More preferably, $V_{11}$ and $V_{13}$ each represents a hydrogen atom and $V_{12}$ represents an alkoxy group containing up to 4 carbon atoms, a phenyl group or a chlorine atom; $V_{11}$ represents an alkoxy group or an alkyl group containing up to 4 carbon atoms and $V_{12}$ represents a hydroxy group or an alkyl group containing up to 4 carbon atoms; or $V_{12}$ and $V_{13}$ are linked to each other to form a fused ring.

When $Z_{12}$ represents a selenium atom, $V_{14}$, $V_{15}$, and $V_{16}$ are respectively the same as defined for $V_{11}$, $V_{12}$, and $V_{13}$ in connection with the case where $Z_{11}$ represents a selenium atom. When $Z_{12}$ represents a sulfur atom and $Z_{11}$ represents a selenium atom, $V_{14}$ represents a hydrogen atom, an alkoxy group containing up to 4 carbon atoms or an alkyl group containing up to 5 carbon atoms, $V_{15}$ represents an alkoxy group containing up to 4 carbon atoms, an optionally substituted phenyl group (preferably a phenyl group; exemplified by a tolyl group and an anisyl group), an alkyl group containing up to 4 carbon atoms, a chlorine atom or a hydroxy group, and $V_{16}$ represents a hydrogen atom, or $V_{14}$ and $V_{15}$, or $V_{15}$ and $V_{16}$, may be linked to each other to form a fused benzene ring.

More preferably, $V_{14}$ and $V_{16}$ each represents a hydrogen atom, and $V_{15}$ represents an alkoxy group containing up to 4 carbon atoms, a chlorine atom or a phenyl group; or $V_{15}$ and $V_{16}$ are linked to each other to form a fused benzene fing. When $Z_{11}$ and $Z_{12}$ both represent a sulfur atom, $V_{14}$ and $V_{16}$ each represents a hydrogen atom and $V_{15}$ represents an optionally substituted phenyl group (e.g., a phenyl group or a tolyl group), or $V_{14}$ represents a hydrogen atom and $V_{15}$ and $V_{16}$ are linked to each other to form a fused benzene ring. When $Z_{11}$ represents an oxygen atom and $Z_{12}$ represents a sulfur atom, $V_{14}$ and $V_{16}$ each represents a hydrogen atom, and $V_{15}$ represents a chlorine atom, an optionally substituted phenyl group or an alkoxy group containing up to 4 carbon atoms, or $V_{15}$ and $V_{16}$ may be linked to each other to form a fused benzene ring; more preferably, $V_{14}$ and $V_{16}$ each represents a hydrogen atom and $V_{15}$ represents a phenyl group, or $V_{15}$ and $V_{16}$ are linked to each other to form a fused benzene ring.

$X_{11}$ represents a counter ion which is required to neutralize a charge on a cyanine dye of formula (I) or (II). Examples of these ions are a halogen ion such as $Cl^-$, $Br^-$, $I^-$, etc.; $No_3^{2-}$; $SO_4^{2-}$;

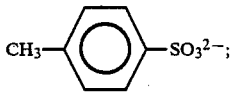

Rhodan ion, etc., as an anion; and an alkali metal ion such as $Li^+$, $Na^+$, $K^+$, etc., an alkali earth metal ion such as $Ca^{2+}$, etc., as a cation.

$m_{11}$ represents 0 or 1 and, in the case of forming inner salt, $m_{11}$ represents 1.

Sensitizing dyes represented by general formula (II) are as follows:

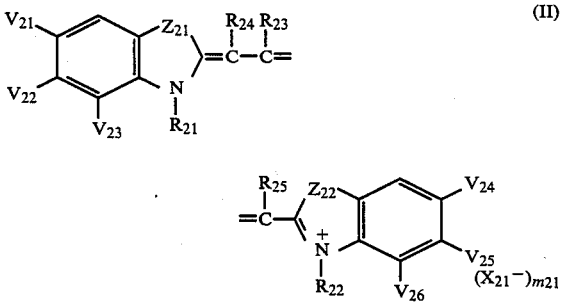

(II)

In the above general formula (II), $Z_{21}$ represents an oxygen atom, a sulfur atom, a selenium atom, or

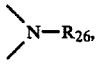

and $Z_{22}$ represents an oxygen atom or

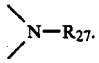

$R_{21}$ and $R_{22}$ are the same as the defined for $R_{11}$ or $R_{12}$ in general formula (I), or $R_{21}$ and $R_{24}$, or $R_{22}$ and $R_{25}$, may be linked to each other to form a 5- or 6-membered carbon ring.

$R_{23}$ represents a hydrogen atom when at least one of $Z_{21}$ and $Z_{22}$ represents

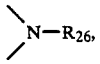

or represents an ethyl group, a propyl group or a butyl group (preferably an ethyl group) in other cases. $R_{24}$ and $R_{25}$ each represents a hydrogen atom.

$R_{26}$ and $R_{27}$ are the same as defined for $R_{11}$ in general formula (I), provided that $R_{21}$ and $R_{26}$, and $R_{22}$ and $R_{27}$, do not represent a sulfo group-containing substituent at the same time.

$V_{21}$ represents a hydrogen atom when $Z_{21}$ represents an oxygen atom, or represents a hydrogen atom, an alkyl group containing up to 5 carbon atoms or an alkoxy group containing up to 5 carbon atoms when $Z_{21}$ represents a sulfur atom or a selenium atom, or represents a hydrogen atom or a chlorine atom when $Z_{21}$ represents

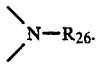

$V_{22}$ represents a hydrogen atom, an alkyl group containing up to 5 carbon atoms, an alkoxy group containing up to 5 carbon atoms, a chlorine atom or an optionally substituted phenyl group (e.g., a tolyl group, an anisyl group, a phenyl group, etc.), or $V_{22}$ may be bonded to $V_{21}$ or $V_{23}$ to form a fused benzene ring when $Z_{21}$ represents an oxygen atom and $Z_{22}$ represents

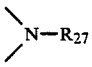

(more preferably $V_{22}$ represents an alkoxy group or a phenyl group, or $V_{21}$ and $V_{22}$, or $V_{22}$ and $V_{23}$ are linked to each other to form a fused benzene ring), or $V_{22}$ represents an optionally substituted phenyl group (e.g., a tolyl group, an anisyl group, a phenyl group, etc., with a phenyl group being more preferable) or may be linked to $V_{21}$ or $V_{23}$ to form a fused benzene ring when $Z_{21}$ and $Z_{22}$ both represent an oxygen atom, or $V_{22}$ represents a hydrogen atom, an alkyl group containing up to 5 carbon atoms, an alkoxycarbonyl group containing up to 5 carbon atoms, an alkoxy group containing up to 4 carbon atoms, an acylamino group containing up to 4 carbon atoms, a chlorine atom or an optionally substituted phenyl group (more preferably) an alkyl group or an alkoxy group containing up to 4 carbon atoms, a chlorine atom or a phenyl group) when $Z_{21}$ represents a sulfur atom or a selenium atom, or may be bonded to $V_{23}$ to form a fused benzene ring when $Z_{21}$ represents a sulfur atom. When $Z_{21}$ represents

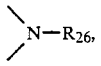

$V_{22}$ represents a chlorine atom, a trifluoromethyl group, a cyano group, an alkylsulfonyl group containing up to 4 carbon atoms or an alkoxycarbonyl group containing up to 5 carbon atoms (preferably $V_{21}$ represents a chlorine atom and $V_{22}$ represents a chlorine atom, a trifluoromethyl group or a cyano group when $Z_{21}$ represents

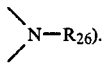

$V_{24}$ represents a hydrogen atom when $Z_{22}$ represents an oxygen atom, or represents a hydrogen atom or a chlorine atom when $Z_{22}$ represents

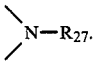

$V_{25}$ represents an alkoxy group containing up to 4 carbon atoms, a chlorine atom or an optionally substituted phenyl group (e.g., a n anisyl group, a tolyl group, a phenyl group, etc.) or may be bonded to $V_{24}$ or $V_{26}$ to form a fused benzene ring when $Z_{22}$ represents an oxygen atom and, more preferably an alkoxy group containing up to 4 carbon atoms, a phenyl group or is preferably bonded to $V_{24}$ or $V_{26}$ to form a fused benzene ring when $Z_{21}$ represents

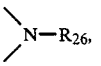

or $V_{25}$ preferably represents a phenyl group or is preferably bonded to $V_{24}$ or $V_{26}$ to form a fused benzene ring when $Z_{21}$ represents an oxygen atom, a sulfur atom or a selenium atom. When $Z_{22}$ represents

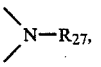

$V_{25}$ represents a chlorine atom, a trifluoromethyl group, a cyano group, an alkylsulfonyl group containing up to 4 carbon atoms or a carboxyalkyl group containing up to 5 carbon atoms. Particularly preferably, $V_{24}$ represents a chlorine atom, and $V_{25}$ represents a chlorine atom, a trifluoromethyl group or a cyano group.

$V_{26}$ represents a hydrogen atom.

$X_{21}$ represents a counter ion which is required to neutralize a charge on a cyanine dye of formula (I) or (II). Examples of these ions are a halogen ion such as $Cl^-$, $Br^-$, $I^-$, etc.; $No_3^+$; $SO_4^{2-}$;

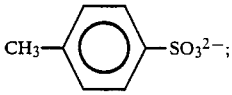

Rhodan ion, etc., as an anion; and an alkali metal ion such as $Li^+$, $Na^+$, $K^+$, etc.; an alkali earth metal ion such as $Ca^{2+}$, etc., as a cation.

$m_{21}$ represents 0 or 1 and, when an inner salt is formed, $m_{21}$ represents 0.

Sensitizing dyes represented by general formula (III) are as follows:

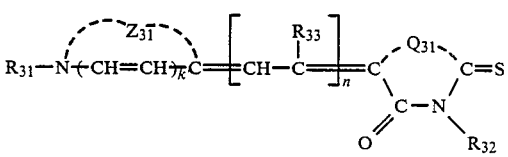

(III)

In the above general formula (II), $Z_{31}$ represents atoms forming a heterocyclic nucleus of thiazoline, thiazole, benzothiazole, naphthothiazole, selenazoline, selenazole, benzoselenazole, naphthoselenazole, benzimidazole, naphthoimidazole, oxazole, benzoxazole, naphthoxazole, or pyridine, with the heterocyclic nucleus being optionally substituted. When $Z_{31}$ represents atoms forming a benzimidazole nucleus or a naphthoimidazole nucleus, substituents for the nitrogen atom at the 1-position other than $R_{31}$ include those illustrated for $R_{26}$ or $R_{27}$ of general formula (II) described above. Substituents in the fused benzene ring of benzimidazole include, for example, a chlorine atom, a cyano group, an alkoxycarbonyl group containing up to 5 carbon atoms, an alkylsulfonyl group containing up to 4 carbon atoms or a trifluoromethyl group. Particularly preferably, the benzimidazole nucleus is substituted by a chlorine atom at the 5-position and by a cyano group, a chlorine atom or a trifluoromethyl group at the 6-position. Substituents for heterocyclic nuclei other than the benzimidazole nucleus, selenazoline nucleus, and thiazoline nucleus include an optionally substituted alkyl group containing a total of up to 8 carbon atoms (examples of the substituents being a hydroxy group, a chlorine atom, a fluorine atom, an alkoxy group, a carboxy group, an alkoxycarbonyl group, a phenyl group or a substituted phenyl group), a hydroxy group, an alkoxycarbonyl group containing up to 5 carbon atoms, a halogen atom, a carboxy group, a furyl group, a thienyl group, a pyridyl group, a phenyl group or a substituted phenyl group (e.g., a tolyl group, an anisyl group, a chlorophenyl group, etc.). Substituents for the selenazoline nucleus or thiazoline nucleus include an alkyl group containing up to 6 carbon atoms, a hydroxyalkyl or alkoxycarbonylalkyl group containing up to 5 carbon atoms, etc.

$R_{31}$ is the same as defined above for $R_{11}$ or $R_{12}$ in general formula (I).

$R_{32}$ is the same as defined above for $R_{11}$ or $R_{12}$ in general formula (I), or represents a hydrogen atom, a furfuryl group or an optionally substituted aryl group (e.g., a phenyl group, a tolyl group, an anisyl group, a carboxyphenyl group, a hydroxyphenyl group, a chlorophenyl group, a sulfophenyl group, a pyridyl group, a 5-methyl-2-pyridyl group, a 5-chloro-2-pyridyl group, a thienyl group, a furyl group, etc.), provided that at least one of $R_{31}$ and $R_{32}$ represents a substituent having a sulfo or carboxy group and the other represents a substituent having no sulfo group.

$R_{33}$ represents a hydrogen atom, an alkyl group containing up to 5 carbon atoms, a phenethyl group, a phenyl group or a 2-carboxyphenyl group, more preferably a hydrogen atom, a methyl group or an ethyl group.

$Q_{31}$ represents an oxygen atom, a sulfur atom, a selenium atom or

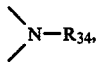

provided that, when $Z_{31}$ represents atoms forming a thiazoline, selenazoline or oxazole nucleus, $Q_{31}$ preferably represents a sulfur atom, a selenium atom or

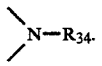

$R_{34}$ represents a hydrogen atom, a pyridyl group, a phenyl group, a substituted phenyl group (e.g., a tolyl group, an anisyl group, etc.), or an aliphatic hydrocarbyl group optionally containing an oxygen atom, a sulfur atom or a nitrogen atom in the carbon chain, optionally having a substituent or substituents, and containing a total of up to 8 carbon atoms.

k represents 0 or 1, and n represents 0 or 1.

When n represents 1 and $Z_{31}$ represents atoms forming a pyridine nucleus, $Q_{31}$ represents an oxygen atom.

The present inventors have completed the novel technique, of providing a spectrally sensitized silver halide color photographic material containing a high silver chloride emulsion capable of being processed with a bleachfixing solution having a pH of not more than about 6.5, more preferably not more than 6.0, for not longer then about 75 seconds, even not longer than 60 seconds and with a substantially benzyl alcohol-free color developer solution containing up to about 0.002 mol/liter of bromide ion for a time as short as not longer than about 2 minutes and 30 seconds to form a color image, by incorporating the spectral sensitizing dyes represented by general formula (I), (II) or (III) described above in detail into the high silver chloride emulsion.

Specific examples of the compounds represented by general formula (I), (II) or (III) are illustrated below as a further description of the present invention which, however, are not to be construed as limiting the scope of the present invention in any manner whatsoever.

I-1

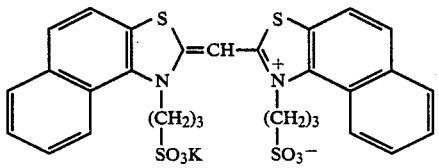

I-2

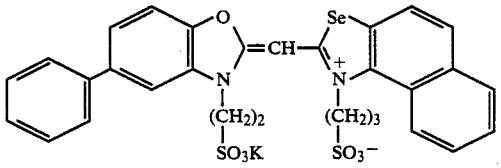

I-3

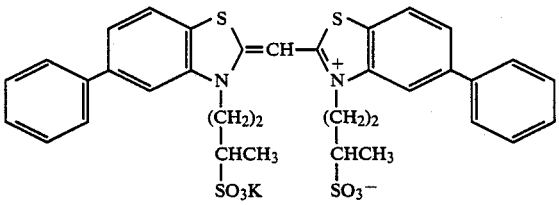

I-4

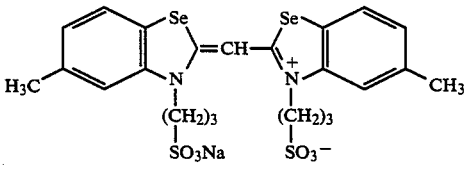

I-5

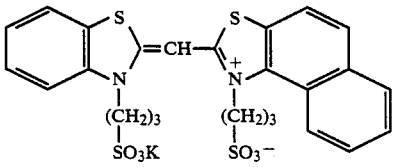

-continued
I-6
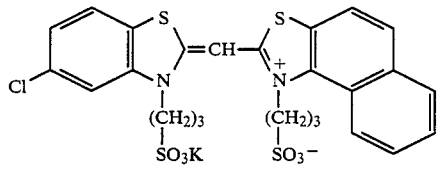
I-7
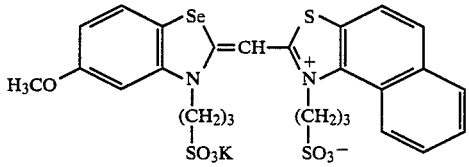
I-8
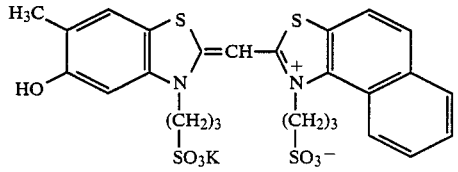
I-9
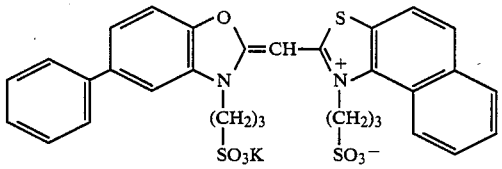
I-10
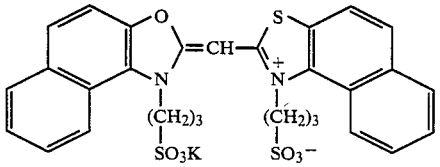
I-11
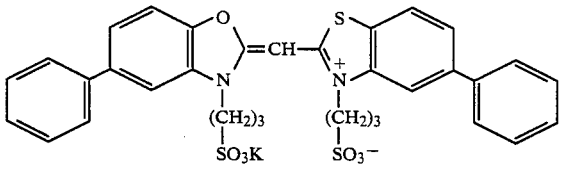
I-12
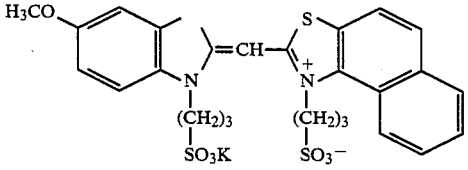
I-13
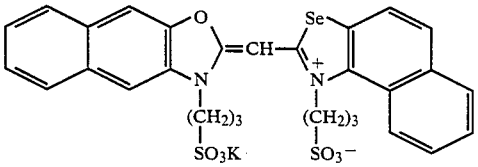

-continued
I-14
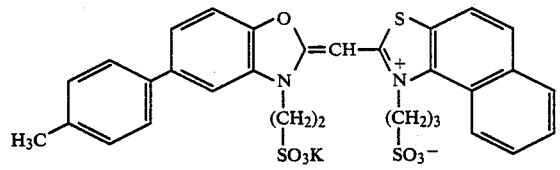
I-15
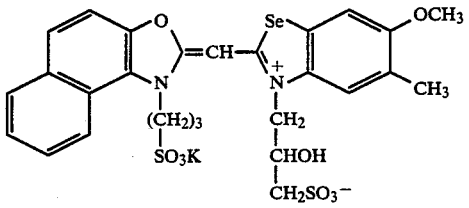
I-16
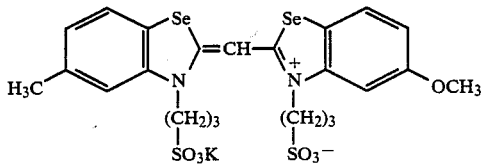
II-1
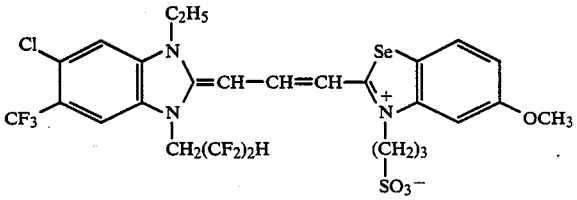
II-2
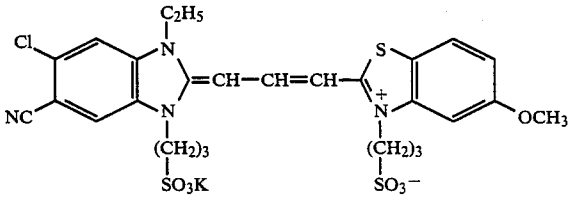
II-3
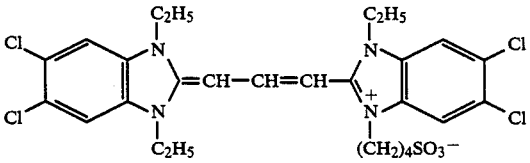
II-4
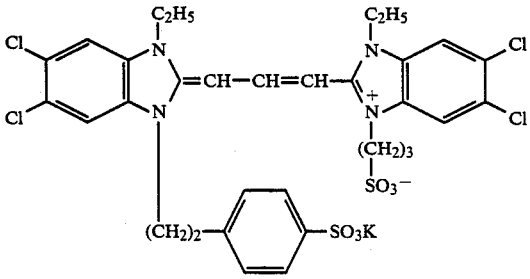

-continued
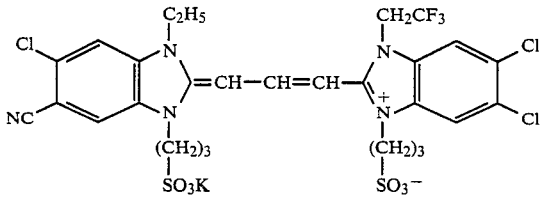
II-5
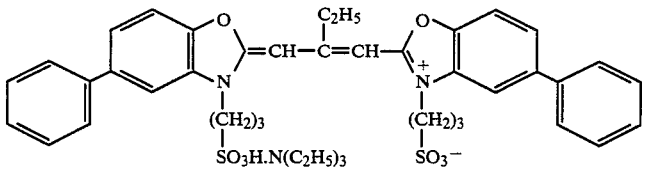
II-6
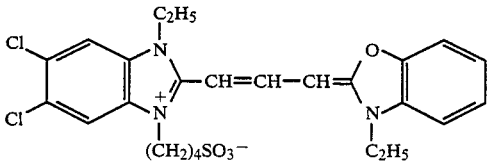
II-7
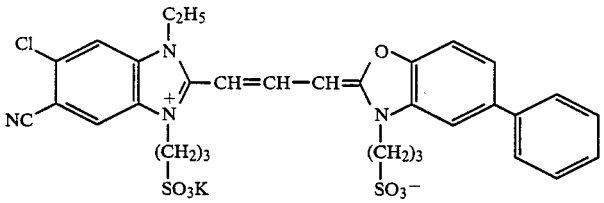
II-8
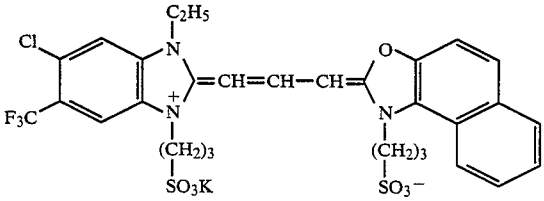
II-9
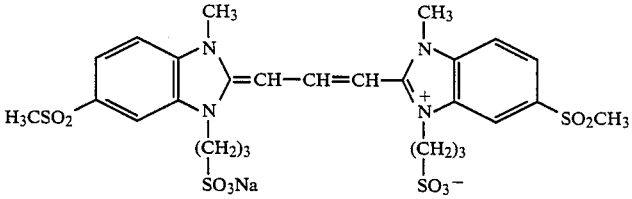
II-10
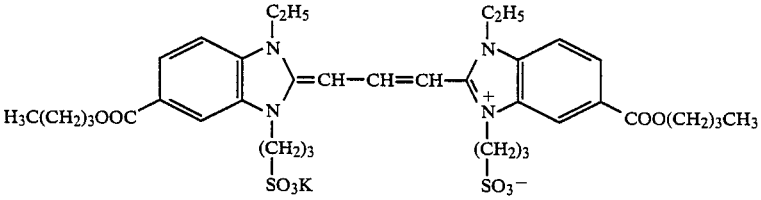
II-11
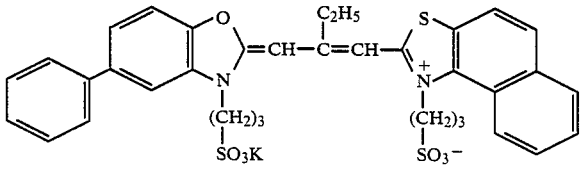
II-12

-continued
II-13
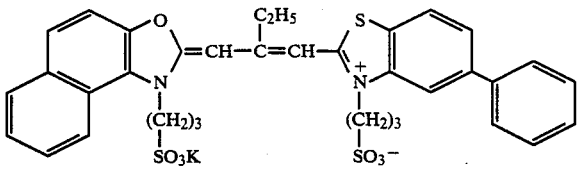
II-14
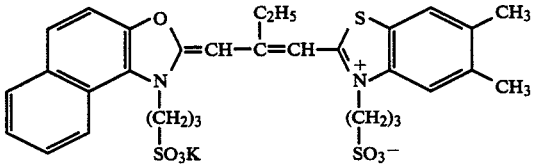
II-15
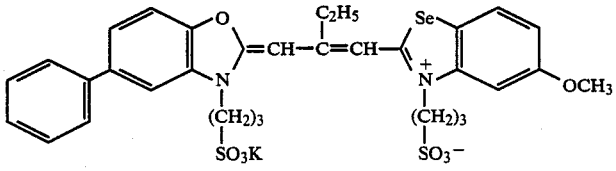
II-16
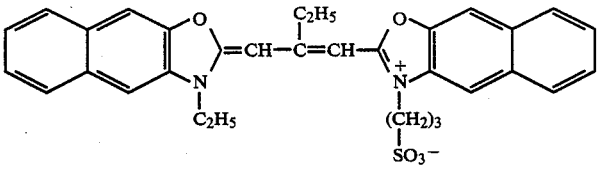
II-17
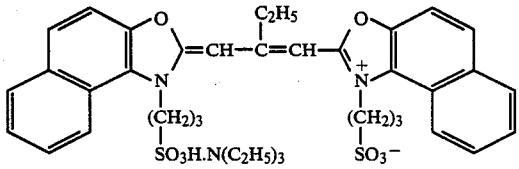
II-18
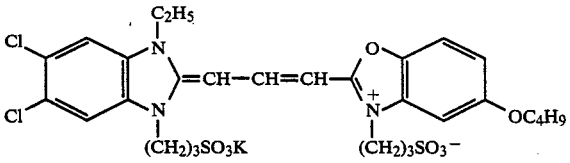
II-19
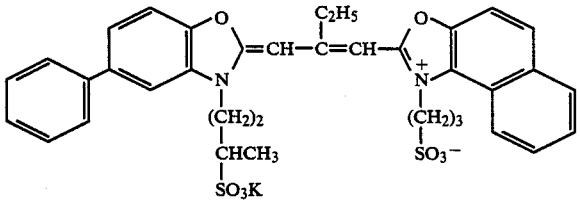
II-20
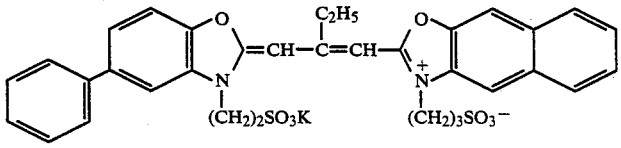

-continued
II-21
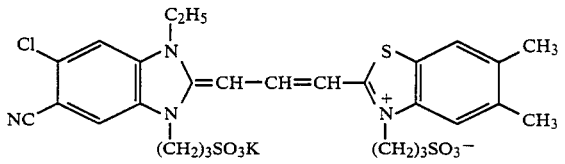
II-22
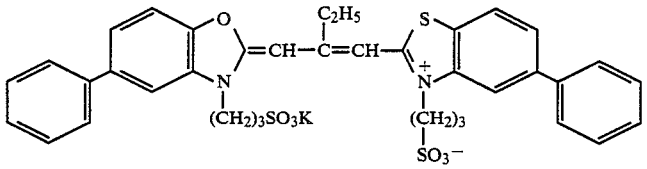
II-23
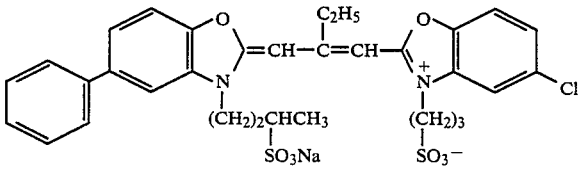
III-1
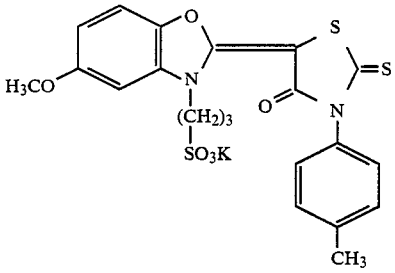
III-2
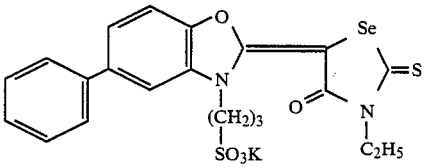
III-3
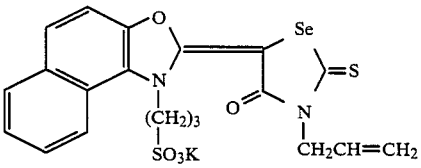
III-4
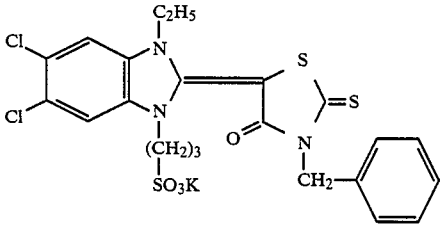
III-5
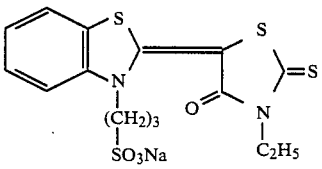

-continued
III-6
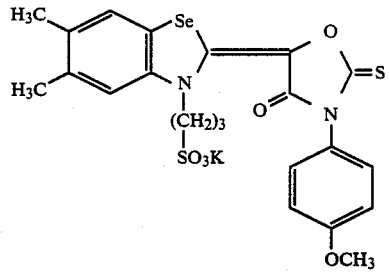
III-7
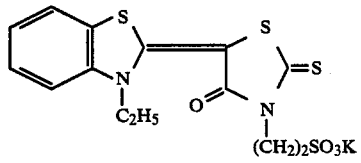
III-8
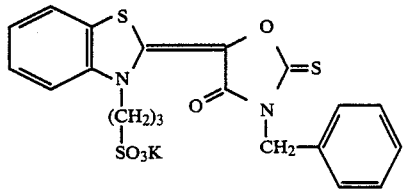
III-9
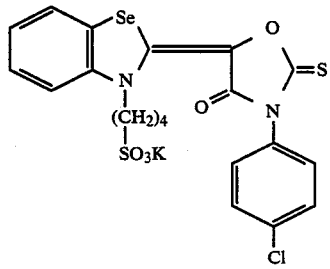
III-10
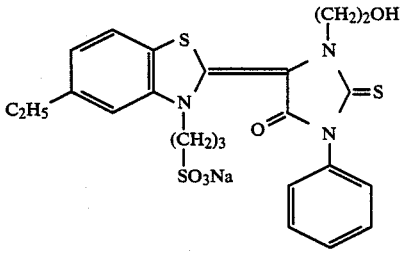
III-11
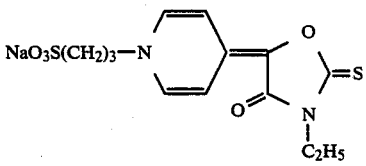
III-12
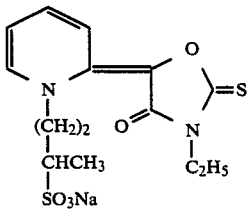

-continued
III-13
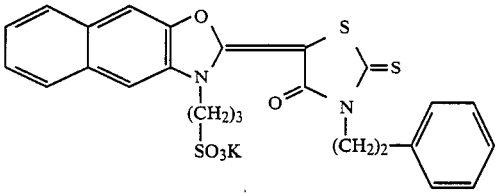
III-14
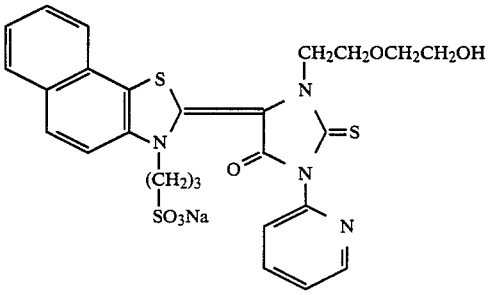
III-15
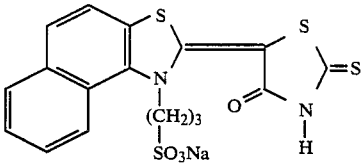
III-16
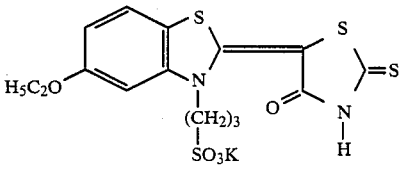
III-17
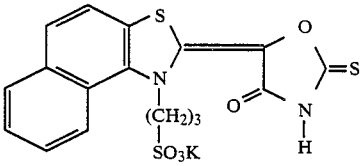
III-18
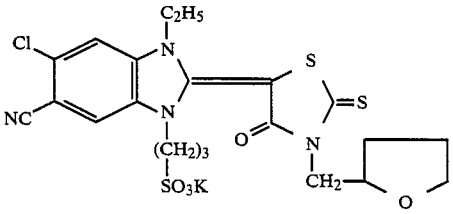
III-19
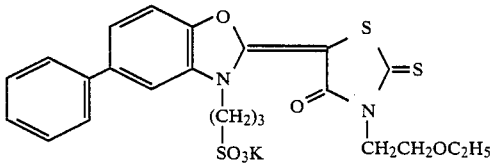

-continued
III-20
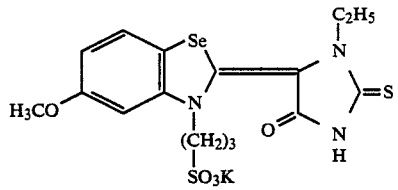
III-21
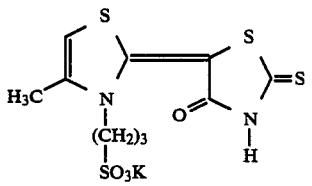
III-22
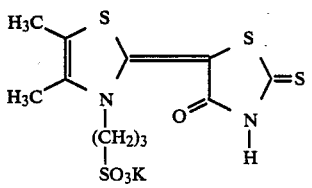
III-23
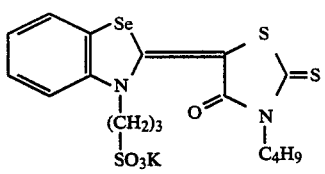
III-24
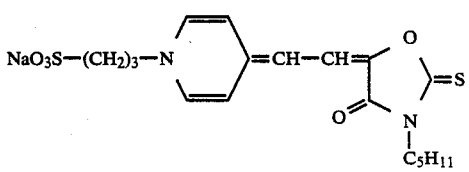
III-25
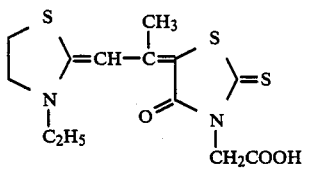
III-26
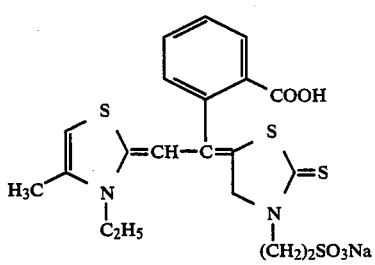
III-27
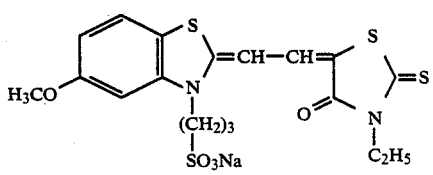

-continued
III-28
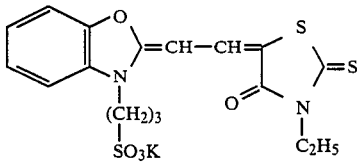
III-29
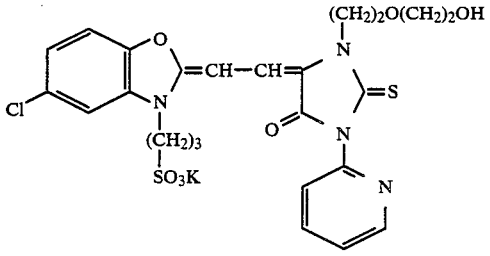
III-30
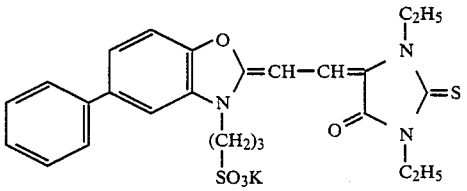
III-31
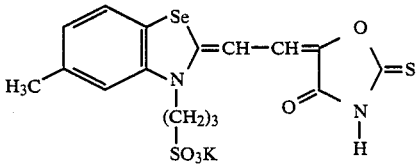
III-32
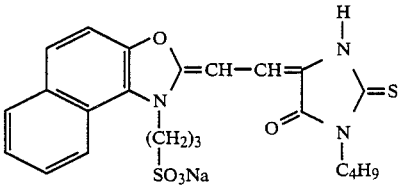
III-33
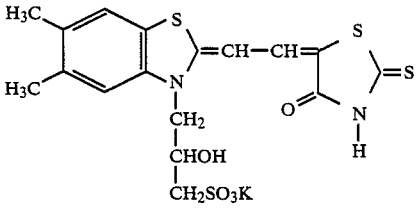
III-34
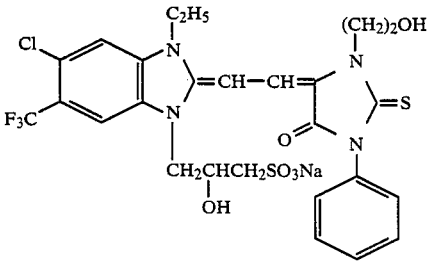

-continued

III-35

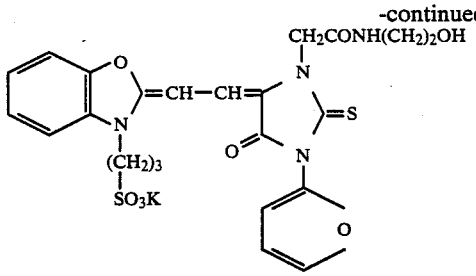

III-36

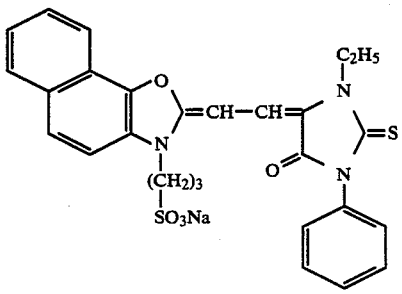

III-37

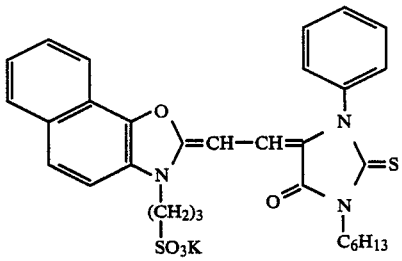

The compounds represented by general formula (I), (II) or (III) to be used in the present invention are known compounds, and may be synthesized by reference to, for example, Japanese patent application (OPI) No. 104917/77, Japanese Patent Publication Nos. 22884/68, 25652/73, 22368/82, etc., F. M. Hamer, *The Chemistry of Heterocyclic Compounds*, Vol. 18, "The Cyanine Dyes and Related Compounds", compiled by A. Weissberger and published by Interscience, New York, 1964, and D. M. Sturmer, *The Chemistry of Heterocyclic Compounds*, Vol. 30, compiled by A. Weissberger and E. C. Taylor and published by John Wiley, New York, 1977, p. 441.

The sensitizing dye represented by general formula (I), (II) or (III) may be added to the high silver chloride emulsion together with a water-soluble bromide salt (e.g., potassium bromide, as described in Japanese Patent Publication No. 46932/74) for the purpose of increasing strengthening adsorption. The bromide salt is added in an amount of preferably up to about 1 mol %, more preferably up to 0.5 mol %, per mol of silver halide.

Incorporation of the sensitizing dye represented by the foregoing general formula (I), (II) or (III) into the silver halide emulsion of the present invention may be conducted by directly dispersing the dye into the emulsion, or by dispersing as a solution in a single solvent of water, methanol, ethanol, propanol, methyl cellosolve, 2,2,3,3-tetrafluoropropanol, etc. or a solvent comprising a mixture thereof. In addition, as is described in Japanese Patent Publication Nos. 23389/69, 27555/69, 22089/82, etc., an acid or a base may be co-present in preparing an aqueous solution of the dye to be added to an emulsion, or a surfactant may be co-present in preparing an aqueous solution or a colloidal dispersion of the dye to be added to an emulsion, as is described in, e.g., U.S. Pat. Nos. 3,882,135, 4,006,025, etc. Further, the dye may be first dissolved in a substantially water-immiscible solvent such as phenoxyethanol, then dispersed in water or a hydrophilic colloid, followed by adding the dispersion to an emulsion. As is described in Japanese patent application (OPI) Nos. 102,733/78 (U.S. Pat. No. 4,140,530) and 105,141/83 (U.S. Pat. No. 4,474,872), the dye may be directly dispersed in a hydrophilic colloid, followed by adding the resulting dispersion to an emulsion. As to the stage of adding the dye to the emulsion, such addition may be conducted at any stage of preparing an emulsion. Most commonly, it is conducted after completion of chemical sensitization and before coating the emulsion on a support. However, the dye may be added simultaneously with a chemical sensitizing agent to effect spectral sensitization simultaneously with chemical sensitization as described in U.S. Pat. Nos. 3,628,969 and 4,225,666, or the dye may be added prior to chemical sensitization as described in Japanese patent application (OPI) No. 113928/83 (U.S. Pat. No.e 4,434,226), or the dye may be added before completion of production of precipitated silver halide grains to initiate spectral sensitization. Further, it is also possible to add the above-mentioned dye in portions, i.e., to add part of the dye prior to chemical sensitization, and the residual portion after chemical sensitization, as is described in U.S. Pat. No. 4,225,666. The addition of the dye may be conducted at any stage during formation of silver halide grains, including the manner described in U.S. Pat. No. 4,183,756.

The sensitizing dye represented by general formula (I), (II) or (III) may be used in an amount of about $4\times10^{-6}$ to about $8\times10^{-3}$ mol per mol of the silver halide emulsion of the layer containing the high silver chloride emulsion. However, when the emulsion contains silver halide grains having an average particle size of 0.2 to 1.2 μm, an amount of about $5\times10^{-5}$ to about $2\times10^{-3}$ mol is more effective.

In a preferred embodiment of the present invention, the color developer preferably substantially excludes benzyl alcohol from the point of view of preventing environmental pollution.

The term "substantially excluding benzyl alcohol" means that the concentration of benzyl alcohol in the color developer is not more than about 0.5 mol/liter, preferably zero.

In a preferred embodiment of the present invention, bromide ion is contained in the color developer in an amount of not more than about 0.002 mol/liter, more preferably not more than 0.0007 mol/liter, particularly preferably zero. If the amount of bromide ion exceeds the above-described upper limit, development is inhibited to such an extent that a sufficient color density becomes difficult to obtain (although this also depends upon the content of silver bromide in the silver halide emulsion).

The silver halide emulsion to be used in the present invention comprises silver halide substantially excluding silver iodide and containing about 80 mol % or more silver chloride. The content of silver chloride is preferably 90 mol % or more, more preferably 95 mol % or more, with pure silver chloride being most preferable.

The term "substantially excluding silver iodide" means that the content of silver iodide is not more than about 1 mol %, preferably not more than 0.5 mol %, most preferably zero %, including silver iodide formed near the surface of silver halide grains by adding a water-soluble iodide salt such as potassium iodide in a slight amount of up to about 5 mol % per mol of silver halide, which is often conducted during spectral sensitization for strengthening adsorption of cyanine dyes (including the compounds represented by general formulas (I), and (II) and formation of J-association to thereby obtain more enhanced spectral sensitization.

The amount of silver halide coated on a support is preferably up to about 0.78 g/m$^2$ in terms of silver amount. If the amount of coated silver halide is too much, development is so prolonged that a sufficient color density in the resulting images becomes difficult to obtain.

The silver halide emulsion to be used in the present invention has an average grain size of preferably about 0.1 μm to about 2 μm, more preferably 0.2 μm to 1.3 μm, in terms of a diameter of a circle equivalent to the projected area. The emulsion is preferably a monodispersed emulsion. The grain size distribution showing the degree of monodission ($s/\bar{d}$) is preferably up to about 0.2, more preferably up to 0.15, in terms of the ratio of statistical standard deviation (s) to average grain size ($\bar{d}$).

The silver halide grains to be used in the present invention may have an internal portion and a surface layer different from each other in phase composition, may be of a multi-phase structure having a junction structure, or may comprise a uniform phase. Further, these various structures and grain compositions may coexist in the emulsion simultaneously.

Silver halide grains to be used in the present invention may be of a regular crystal form or shape such as cubic, octahedral, dodecahedral or tetradecahedral, or may be of irregular crystal form or shape, such as spherical, or in a mixed form thereof. In addition, platy grains are also suitable. Emulsions wherein platy grains having a length-to-thickness ratio of about 5 or more, particularly 8 or more, account for about 50% or more of the total projected area of the grains, may also be used. Emulsion comprising a mixture of these various crystal forms may be used as well. Either of surface latent image-forming silver halide grains forming latent images mainly on the surface thereof and internal latent image-forming grains forming latent images internally may also be used.

Photographic emulsions to be used in the present invention may be prepared according to processes described in P. Glafkides, *Chimie et Physique Photographique* (Paul Montel, 1967), G. F. Duffin, *Photographic Emulsion Chemistry* (Focal Press, 1966), V. L. Zelikman et al, *Making and Coating Photographic Emulsion* (Focal Press, 1964), etc. That is, any of an acidic process, a neutral process and an ammonia process can be used. As a manner of reacting a soluble silver salt with a soluble halide salt, any of side-mixing, simultaneous mixing, and a combination thereof may be employed.

A process of forming grains in the presence of excess silver ion (called a reverse mixing process) can be employed as well. One type of simultaneous mixing is a controlled double jet process wherein the pAg in a liquid phase in which silver halide is formed is kept constant. This process provides a silver halide emulsion containing silver halide grains of regular crystal form having an approximately uniform grain size.

Further, emulsions prepared according to a so-called conversion process which involves the step of converting already-formed silver halide to silver halide with a lower solubility product before completion of the silver halide grain-forming step, and emulsions subjected to the same halide conversion after completion of the silver halide grain-forming step, are also suitable herein.

During formation or physical ripening of the silver halide grains, zinc salts, lead salts, thallium salts, iridium salts or the complex salts thereof, rhodium salts or the complex salts thereof, iron salts or the complex salts thereof, etc. may be co-present.

After formation of the grains, the silver halide emulsion is usually subjected to physical ripening, desalting, and chemical ripening before being coated on a support.

Known silver halide solvents (for example, ammonia, potassium rhodanide, or thioethers and thione compounds described in U.S. Pat. No. 3,271,157, Japanese patent application (OPI) Nos. 82,408/78, 144,319/78 (G.B. 1,586,412), 100,717/79, 155,828/79 (U.S. Pat. No. 4,276,374), etc.) may be used upon precipitation, physical ripening, and chemical ripening. In order to remove soluble silver salts from physically ripened emulsion noodle-washing, a flocculation process, an ultrafiltration process, etc. are employed.

A sulfur sensitization process using a sulfurcontaining compound (e.g., a thiosulfate, a thiourea, a mercapto compound, a rhodanine, etc.) may be applied to the silver halide emulsion to be used in the present invention; a reduction sensitization process using a reductive substance (e.g., a stannous salt, an amine, a hydrazine derivative, formamidinesulfinic acid, a silane compound, etc.); a noble metal sensitization process using a metal compound (e.g., a gold complex or complex salts of the group VIII metals in the Periodic Table such as Pt, Ir, Pd, Rh, Fe, etc.) may also be used alone or in combination.

Antifoggants described in, for example, U.S. Pat. Nos. 3,954,474 and 3,982,947, Japanese Patent Publication No. 28660/77, *Research Disclosure*, No. 17643 (December, 1978), Chapters VIA-VIM, and E. J. Birr, *Stabilization of Photographic Silver Halide Emulsions* (Focal Press, 1974), etc. may be used in the light-sensitive material to be used in the present invention. Suitable antifoggants are hydroxytetraazaindenes including 4-hydroxy-6-methyl-1,3,3*a*,7-tetraazaindene, and mercapto-substituted heterocyclic compounds such as 1-(3-(3-methylureido)phenyl)-5-mercaptotetrazole, 1-(3-acetylaminophenyl)-5-mercaptotetrazole, 1-phenyl-5-mercaptotetrazole, 2-amino-5-mercaptothiadiazole, 3-hexanoylamino-4-methyl-5-mercapto-1,2,4-triazole, 2-mercaptobenzothiazole, etc. are particularly preferable.

In order to obtain a target gradation of the color photographic light-sensitive material of the present invention, two or more monodispersed silver halide emulsions (having monodispersed properties of the aforementioned degree of variability being preferable) different from each other in grain size may be used in the same layer as a mixture, or in different layers to be coated one over the other, to thereby form emulsion layers having substantially the same color sensitivity. Further, two or more kinds of polydispersed silver halide emulsions or a combination of a monodispersed emulsion and a polydispersed emulsion may be used as a mixture or as present in different layers to be coated one over the other.

Color couplers to be incorporated in light-sensitive materials preferably have a ballast group or are polymerization to acquire diffusion resistance. In comparison with 4-equivalent couplers having a hydrogen atom in the coupling-active sites, two-equivalent couplers substituted by coupling-off groups in the coupling-active sites permit a reduction in the amount of coated silver. Couplers which can form colored dyes with suitable diffusibility, non-color forming couplers, DIR couplers capable of releasing a development inhibitor upon undergoing a coupling reaction, or couplers capable of releasing a development inhibitor may also be used.

Typical examples of yellow couplers to be used in the present invention include oil protection type acylacetamide couplers. Specific examples thereof are described in U.S. Pat. Nos. 2,407,210, 2,875,057, 3,265,506, etc. In the present invention, the use of two-equivalent yellow couplers is preferable, and typical examples thereof include yellow couplers of the oxygen atom coupling-off type, described in U.S. Pat. Nos. 3,408,194, 3,447,928, 3,933,501 and 4,022,620 and yellow couplers of the nitrogen atom coupling-off type, described in Japanese Patent Publication No. 10739/83, U.S. Pat. Nos. 4,401,752, 4,326,024, *Research Disclosure* No. 18053 (April, 1979), British Patent 1,425,020, West German OLS Nos. 2,219,917, 2,261,361, 2,329,587 and 2,433,812. α-Pivaloylacetanilide type couplers are excellent in fastness, particularly light fastness, of colored dyes, whereas α-benzoylacetanilide type couplers provide high coloration density.

Magenta couplers to be used in the present invention include oil protection type indazolone or cyanoacetyl, preferably 5-pyrazolone and pyrazoloazole (e.g., pyrazolotriazoles) couplers. Of the 5-pyrazolone couplers, those which are substituted by an arylamino group or an acylamino group at the 3-position are preferable in view of the resulting hue and coloration density of colored dyes. Typical examples thereof are described in U.S. Pat. Nos. 2,311,082, 2,343,703, 2,600,788, 2,908,573, 3,062,653, 3,152,896 and 3,936,015, etc. As coupling-off groups for 2-equivalent, 5-pyrazolone couplers, nitrogen atom coupling-off groups, described in U.S. Pat. No. 4,310,619 and arylthio groups described in U.S. Pat. No. 4,351,897 are particularly preferable. Ballast group containing 5-pyrazolone couplet described in European Patent No. 73,636 also provide high coloration density.

Suitable pyrazoloazole type couplers include pyrazolobenzimidazoles, described in U.S. Pat. No. 3,369,879, preferably pyrazolo(5,1-c)(1,2,4)triazoles described in U.S. Pat. No. 3,725,067, pyrazolotetrazoles described in *Research Disclosure*, No. 24220 (June, 1984) and pyrazolopyrazoles described in *Research Disclosure*, No. 24230 (June, 1984). Imidazo(1,2-b)pyrazoles described in European Patent 119,741 are preferable in the point of avoidable undesirable side yellow absorption and obtaining excellent light fastness of formed dyes, and pyrazolo(1,5-b)(1,2,4)triazoles described in European Patent 119,860 are particularly preferable.

Cyan couplers to be used in the present invention include oil protection type naphtholic and phenolic couplers. Typical examples thereof include naphtholic couplers described in U.S. Pat. No. 2,474,293, preferably oxygen atom coupling-off type 2-equivalent naphtholic couplers described in U.S. Pat. Nos. 4,052,212, 4,147,396, 4,228,233 and 4,296,200. Specific examples of the phenolic couplers are described in U.S. Pat. Nos. 2,369,929, 2,801,171, 2,771,162, 2,895,826, etc. Cyan couplers exhibiting fastness against high humidity and high temperatures are preferably used in the present invention, and typical examples thereof include phenolic cyan couplers having an ethyl or higher alkyl group at the m-position of the phenol nucleus, described in U.S. Pat. No. 3,772,002, 2,5-diacylamino-substituted phenolic couplers described in U.S. Pat. Nos. 2,772,162, 3,758,308, 4,126,396, 4,334,011, 4,327,173, West German Patents OLS No. 3,329,729, Japanese patent application (OPI) No. 166,956/84, etc. and phenolic couplers having a phenylureido group at the 2-position and an acylamino group at the 5-position, described in U.S. Pat. Nos. 3,446,622, 4,333,999, 4,451,559, 4,427,767, etc.

Graininess can be improved by using those couplers which form dyes with proper diffusibility. Such couplers forming diffusible dyes include the couplers illustrated in U.S. Pat. No. 4,366,237 and British Patent No. 2,125,570, which describe specific examples of magenta couplers, and European Patent 96,570 and West German Patent OLS No. 3,234,533, which describe specific examples of yellow, magenta, or cyan couplers.

The dye-forming couplers and the above-described special couplers may comprise a dimer or higher polymer. Typical examples of polymerized dye-forming couplers are described in U.S. Pat. Nos. 3,451,820 and 4,080,211. Specific examples of polymerized magenta couplers are described in British Patent 2,102,173 and U.S. Pat. No. 4,367,282.

Two or more of the various above-described couplers to be used in the present invention may be used in one and the same light-sensitive layer, or one coupler may be used in two or more layers for obtaining photographic properties required for light-sensitive materials.

The couplers to be used in the present invention may be introduced into light-sensitive materials according to the oil-in-water dispersing process, wherein couplers are dissolved in one solvent or in a mixture of solvents selected from high-boiling point organic solvents having a boiling point of 175° C. or above, and low-boiling point solvents called auxiliary solvents having a boiling point of ° C. or below, and the resulting solution is then finely dispersed in water or an aqueous medium such as a gelatin aqueous solution in the presence of a surface active agent. Examples of the high-boiling point organic solvents are described in U.S. Pat. No. 2,322,027, etc. The dispersing procedure may be accompanied by phase inversion. If necessary, the auxiliary solvent may be removed partly or wholly from the coupler dispersion before coating, by distillation, noodle-washing with water, ultrafiltration, or the like.

Specific examples of the high-boiling point organic solvents include phthalates (e.g., dibutyl phthalate, dicyclohexyl phthalate, di-2-ethylhexyl phthalate, decyl phthalate, etc.), phosphates or phosphonates (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphate, etc.), benzoates (e.g., 2-ethylhexyl benzoate, dodecyl benzoate, 2-ethylhexyl p-hydroxybenzoate, etc.), amides (e.g., diethyldodecanamide, N-tetradecylpyrrolidone, etc.), alcohols or phenols (e.g., isostearyl alcohol, 2,4-di-tert-amylphenol, etc.), aliphatic carboxylates (e.g., dioctyl azelate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), etc.

Suitable auxiliary solvents include organic solvents having a boiling point of about 30° C. or above, preferably 50° C. to up to about 160° C. Typical examples thereof include ethyl acetate, butyl acetate, ethyl propionate, methyl ethyl ketone, cyclohexanone, 2-ethoxyethyl acetate, dimetylformamide, etc.

Specific steps for conducting the latex dispersion process, effects, and specific examples of the latexes are described in U.S. Pat. No. 4,199,363, West German Patent OLS Nos. 2,541,274 and 2,541,230, etc.

Standard amounts of the color couplers to be used range from about 0.001 to about 1 per mol of light-sensitive silver halide, preferably about 0.01 to about 0.5 mol for yellow couplers, about 0.003 to about 0.3 mol per magenta couplers, and about 0.002 to about 0.3 mol for cyan couplers.

The light-sensitive material to be prepared in accordance with the present invention may contain hydroquinone derivatives, aminophenol derivatives, amines, gallic acid derivatives, catechol derivatives, ascorbic acid derivatives, non-color forming couplers, sulfonamidophenol derivatives, etc. as color fog-preventing agents or color mixing-preventing agents.

The light-sensitive material in accordance with the present invention may also contain known anti-fading agents; typical examples include hydroquinones, 6-hydroxychromans, 5-hydroxycoumarans, spirochromans, p-alkoxyphenols, hindered phenols including bisphenols, gallic acid derivatives, methylenedioxybenzenes, aminophenols, hindered amines, and ether or ester derivatives obtained by silylation or alkylation of the phenolic hydroxy groups of these compounds. In addition, metal complexes represented by (bissalicylaldoximato)-nickel complexes and (bis-N,N-dialkyldithiocarbamato)nickel complexes may also be used.

Compounds which have a partial structure of both a hindered amine and a hindered phenol, as described in U.S. Pat. No. 4,268,593, exert favorable effects as to prevention of deterioration of yellow dye images by heat, humidity, and light. In order to prevent deterioration f magenta dye images, particularly deterioration by light, spiroindanes described in Japanese patent application (OPI) No. 159644/81 and hydroquinone diether- or monoether-substituted chromans described in Japanese patent application (OPI) No. 89835/80 provide good results.

Benzotriazole type ultraviolet ray-absorbing agents are preferably used for improving the preservability of cyan images, particularly light fastness thereof. The ultraviolet ray absorbent may be coemulsified with cyan couplers.

As to the amount of ultraviolet ray absorbent to be coated, it suffices to coat the same in a sufficient amount to impart light stability to cyan dye images. However, if used in excess, the absorbent can cause yellowing of unexposed areas (white background) of color photographic light-sensitive materials. Thus, the amount usually ranges from about $1\times10^{-4}$ mol/m$^2$ to about $2\times10^{-3}$ mol/m$^2$, particularly $5\times10^{-4}$ mol/m$^2$ to $1.5\times10^{31\ 3}$ mol/m$^2$.

In the structure of light-sensitive layers of conventional color papers, the ultraviolet ray absorbent is incorporated in either, or preferably both, of the layers adjacent to a cyan coupler-containing, red-sensitive emulsion layer. In the case of adding the ultraviolet ray absorbent to an interlayer between a green-sensitive layer and a red-sensitive layer, the absorbent may be coemulsified with a color mixing-preventing agent. Where the ultraviolet ray absorbent is added to a protective layer, another protective layer may be provided thereon as an outermost layer. In this outer protective layer may also be incorporated a matting agent of any particle size, etc.

In the light-sensitive material of the present invention, the ultraviolet ray absorbent may also be added to a hydrophilic colloidal layer.

The light-sensitive material of the present invention may contain in a hydrophilic colloidal layer a water-soluble dye as a filter dye, or for other various purposes such as prevention of irradiation of halation.

The light-sensitive material of the present invention may contain in a photographic emulsion layer or another hydrophilic colloidal layer a brightening agent, such as a stilbene type, triazine type, oxazole type, coumarin type or the like. Water-soluble brightening agents may be used as such, and water-insoluble brightening agents may be used in the form of dispersion, if desired.

It is preferable to provide auxiliary layers such as a protective layer, an interlayer, a filter layer, an antihalation layer, a backing layer, etc. in addition to the silver halide emulsion layers, as would be understood by one of ordinary skill in the part.

Gelatin is advantageously used as a binder or a protective colloid in the emulsion layers and the interlayers of the light-sensitive material in accordance with the present invention. However, other hydrophilic colloids can be used as well. For example, proteins such as gelatin derivatives, graft polymers of gelatin and other high molecular weight polymers, albumin, casein, etc.; cellulose derivatives such as hydroxyethyl cellulose, carboxymethylcellulose, cellulose sulfate, etc.; sugar derivatives such as sodium alginate, starch derivatives, etc.; and various synthetic hydrophilic substances such as homopolymers or copolymers (e.g., polyvinyl alcohol, partially acetallized polyvinyl alcohol, poly-N-vinylpyrrolidone, polyacrylic acid, polymethacrylic acid, polyacrylamide, polyvinyl imidazole, polyvinyl pyrazole, etc.) can also be used.

Acid-processed gelatin or enzyme-processed gelatin, as described in *Bull. Soc. Sci. Phot. Japan*, No. 16, p. 30 (1966) may be used as specific types of gelatin, as well as lime-processed gelatin, and a gelatin hydrolyzate or an enzyme-decomposed product can also be used.

In addition to the above-described additives, various stabilizers, stain-preventing agents, developing agents or precursors thereof, development-promoting agents or precursors thereof, lubricants, mordants, matting agents, antistatic agents, plasticizers or other additives useful for photographic light-sensitive materials may be added to the light-sensitive material of the present invention. Typical examples of these additives are described in *Research Disclosure*, No. 17643 (December, 1978) and *Research Disclosure*, No. 18716 (November, 1979).

Reflective supports are preferred as the support to be used in the present invention. The term "reflective supports" as used herein means those which have an enhanced reflectivity to render distinct dye images formed in the silver halide emulsion layer. Such reflective supports include those which have coated thereon a hydrophobic resin containing dispersed therein a light-reflecting material such as titanium oxide, zinc oxide, calcium carbonate or calcium sulfate, and those which comprise a hydrophobic resin containing dispersed therein the light-reflecting material. For example, baryta paper, polyethylene-coated paper, polypropylene type synthetic paper, and transparent supports having provided thereon a reflective layer or containing therein a reflective material (for example, glass plate, polyester films (e.g., polyethylene terephthalate film, cellulose triacetate film or cellulose nitrate film), polyamide films polycarbonate films, polystyrene films, etc.) can be used.

Paper supports may be selected from these abovedescribed supports depending upon the ultimate end-use of the photographic material, as would be apparent to the skilled artisan.

Processing steps (image-forming steps) employed in the photographic processing of the present invention are described below.

In the present invention, color development may be conducted within a total time of about 2 minutes and 30 seconds. A preferable developing time ranges from 10 seconds to 2 minutes. The term "developing time" as used herein means the time starting from the stage where the silver halide color photographic material is brought into contact with a color developer solution until the time where the material is brought into contact with the next bath, including the time necessary for transporting the material from bath to bath.

The primary aromatic amine color-developing agents to be used in the color developer include those which are known and are commonly used in various color photographic processes. Such developing agents include aminophenol type and p-phenylenediamine type derivatives. Preferred examples are p-phenylenediamine derivatives, and typical examples thereof are illustrated below which, however, are not intended to limit the scope of the present invention in any manner:

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-ethyl-N-(β-hydroxyethyl)amino]aniline
D-5: 2-Methyl-4-[N-ethyl-N-(β-hydroxyethyl-)amino]aniline
D-6: N-Ethyl-N-(β-methanesulfonamidoethyl)-3-methyl-4-aminoaniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline These p-phenylenediamine derivatives may be used in salt forms, such as sulfates, hydrochlorides, sulfites, p-toluenesulfonates, etc. The above-described compounds are described in U.S. Pat. Nos. 2,193,015, 2,552,241, 2,566,271, 2,592,364, 3,656,950, 3,698,525, etc. The aromatic primary amine developing agents are used in amounts of about 0.1 g to about 20 g, more preferably 0.5 g to 10 g, per liter of the developing solution.

As is well known, the color developer to be used in the present invention may contain a hydroxylamine.

Although hydroxylamines may be used in a color developer in the form of free amine, it is more common to use them in the form of water-soluble acid addition salts. General examples of such salts include sulfates, oxalates, hydrochlorides, phosphates, carbonates, acetates, etc. The hydroxylamines may be substituted or unsubstituted, and the nitrogen atom thereof may be mono- or di-substituted by an alkyl group.

The amount of hydroxylamine to be added preferably ranges from 0 to about 10 g, more preferably from 0 to 5 g, per liter of the color developer. If the stability of the color developer is assured by other means, the amount of hydroxylamine is preferably minimized.

As a preservative, sulfites such as sodium sulfite, potassium sulfite, sodium bisulfite, potassium bisulfite, sodium metasulfite, potassium metasulfite, etc. or carbonylsulfuric acid adducts may be incorporated in the developer bath.

These preservatives are added in amounts of preferably 0 g to about 20 g per liter, more preferably 0 g to 5 g per liter and, as long as the stability of the developer is assured by other means, the amounts are preferably minimized.

Other suitable preservatives include aromatic polyhydroxy compounds described in Japanese patent application (OPI) Nos. 49828/77, 47038/81, 32140/81, 160142/84, and U.S. Pat. No. 3,746,544; hydroxyacetones described in U.S. Pat. No. 3,615,503 and British Patent No. 1,306,176; α-aminocarbonyl compounds described in Japanese patent Application (OPI) Nos. 143020/77 and 89425/78; various metals described in Japanese patent application (OPI) Nos. 44148/82 and 53749/82; various sugars described in Japanese patent application (OPI) No. 102727/77; hydroxamic acids described in Japanese patent application No. 27638/77; α,α'-dicarbonyl compounds described in Japanese patent application (OPI) No. 160141/84; salicylic acids described in Japanese patent application (OPI) No. 180588/84; alkanolamines described in Japanese patent application (OPI) No. 3532/79; poly(alkyleneimines)

described in Japanese patent application (OPI) No. 94349/81; gluconic acids described in Japanese patent application (OPI) No. 75647/81; etc. These preservatives may be used, if necessary, as a combination of two or more. In particular, the use of 4,5-dihydroxy-m-benzenedisulfonic acid, poly(ethyleneimine), triethanolamine, etc. are preferred.

The color developer solution to be used in the present invention has a pH of preferably about 9 to about 12, more preferably 9 to 11.0, and may contain other known developer components, as desired.

In order to maintain the pH of the developer within the range described above, various buffers are preferably used, such as phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, tris-hydroxyaminomethane salts, lysine salts, etc. Of these, phosphates, tetraborates, and hydroxybenzoates have the advantages that they are excellent in solubility and buffering ability in a high pH region of pH 9.0 or more, they do not adversely affect photographic properties (for example, fogging) when added to a color developer, and they are inexpensive, thus being particularly preferable to use.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxy-benzoate (potassium 5-sulfosalicylate), etc. However, the present invention is not limited to these compounds.

The buffers are added to a color developer in an amount of preferably not less than about 0.1 mol/liter, particularly preferably 0.1 mol/liter to 0.4 mol/liter.

In addition, various chelating agents may be used for preventing precipitation of calcium or magnesium or for improving stability of a color developer solution.

Organic acid compounds are preferred as the chelating agents. For example, aminopolycarboxylic acids described in Japanese Patent Publication Nos. 30496/73 and 30232/69; organophosphonic acids described in Japanese Patent Application (OPI) No. 97347/81, Japanese Patent Publication No. 39359/81 and West German Patent No. 2,227,639; phosphonocarboxylic acids described in Japanese Patent Application (OPI) Nos. 102726/77, 42730/78, 121127/79, 126241/80 and 65856/80; and those compounds which are described in Japanese patent application (OPI) Nos. 195845/83, 203440/83, and Japanese Patent Publication No. 40900/78 can be used. Specific examples thereof are illustrated below, which, however, do not limit the scope of the present invention in any manner:

Nitrilotriacetic acid
Diethyleneaminopentaacetic acid
Ethylenediaminetetraacetic acid
Triethylenetetraminehexaacetic acid
N,N,N-Trimethylenephosphonic acid
Ethylenediamine-N,N-N',N'-tetramethylenephosphonic acid
1,3-Diamino-2-propanol-tetraacetic acid
trans-Cyclohexanediaminetetraacetic acid
Nitrilotripropionic acid
1,2-Diaminopropanetetraacetic acid
Hdyroxyethyliminodiacetic acid
Glycol ether diaminetetraacetic acid
Hydroxyethylenediaminetriacetic acid
Ethylenediamine-o-hydroxyphenylacetic acid
2-Phosphonobutane-1,2,4-tricarboxylic acid
1-Hydroxyethane-1,1-diphosphonic acid
N,N'-Bis(2-hydroxybenzyl)ethylenediamine-N,N'-diacetic acid If necessary, these chelating agents may be used as a combination of two or more. It suffers to add these chelating agents in a sufficient amount to mask or tie up the metal ions in the color developer solution. For example, they may be added in an amount of about 0.1 g to about 10 g per liter.

A development accelerator may be added to the color developer as the occasion demands.

Suitable development accelerators include thioether compounds described in Japanese Patent Publication Nos. 16088/63, 5987/62, 7826/63, 12380/69, 9019/70, and U.S. Pat. No. 3,813,247; p-phenylenediamine compounds described in Japanese patent application (OPI) Nos. 49829/77 and 15554/75; quaternary ammonium salts described in Japanese Patent Application (OPI) No. 137726/75, Japanese Patent Publication No. 30074/69, Japanese patent application (OPI) Nos. 156826/81 and 43429/77; p-aminophenol compounds described in U.S. Pat. Nos. 2,610,122 and 4,119,462; amine compounds described in U.S. Pat. Nos. 2,494,903, 3,128,182, 4,230,796, 3,253,919, Japanese Patent Publication No. 11431/66, U.S. Pat. Nos. 2,482,546, 2,596,962 and 3,582,346; polyalkylene oxides described in Japanese Patent Publication Nos. 16088/62, 25201/67, U.S. Pat. No. 3,128,183, Japanese Patent Publication Nos. 11431/66, 23883/67, and U.S. Pat. No. 3,532,501; 1-phenyl-3-pyrazolidones; hydrazines; mesoionic compounds; thione compounds; imidazoles; etc., and may be added as the situation demands.

A slight amount of bromide may be added to the color developer of the present invention for maintaining uniformity of development. However, it is preferred to add the bromide in an amount of up to about 0.002 mol/liter, more preferably up to 0.0007 mol/liter, as has been mentioned hereinbefore.

An antifoggant may also be added to the color developer of the present invention.

Suitable antifoggants include alkali metal halides such as potassium bromide, sodium chloride, potassium iodide, etc., but other organic antifoggants may also be used. Organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chloro-benzotriazole, 2-thiazolylbenzimidazole, 2-thiazolylmethyl-benzimidazole, hydroxyazaindolizine, etc., mercapto-substituted heterocyclic compounds such ad 2-mercaptobenzimidazole, 1-(3-(3-methylureido)phenyl)-5-mercaptotetrazole, 1-(3-acetylaminophenyl)-5-mercaptotetrazole, 2-amino-5-mercaptothiadiazole, 3-hexanoylamino-4-methyl-5-mercapto-1,2,4-triazole, 2-mercaptobenzothiazole, etc., adenine, and mercapto-substituted aromatic compounds such as thiosalicylic acid. These antifoggants may be dissolved out of the color light-sensitive material during processing thereof, thus accumulating in the color developer. However, the amount of accumulated antifoggants is preferably minimized in view of reducing the amount of developer to be discharged.

The color developer of the present invention preferably contains a fluorescent brightening agent as well, and 4,4-diamino-2,2'-disulfostilbene compounds are preferable. These compounds are added in an amount of 0 to about 5 g/liter, preferably 0.1 to 2 g/liter.

If necessary, various surfactants such as alkylphosphonic acids, arylphosphonic acids, aliphatic carboxylic acids, aromatic carboxylic acids, etc. may be used to the color developer.

The processing temperature of the color developer to be used in the present invention ranges preferably from about 30° C. to about 50° C., more preferably 33° C. to 42° C. The amount of replenishing developer is 30 ml to 2000 ml, preferably 30 ml to 1500 ml, per $m^2$ of the light-sensitive material to be developed. In view of reducing the amount of waste solution, the replenishing amount is preferably minimized.

Bleaching agents to be used in the bleaching solution or bleach-fixing solution include ferric ion complexes between ferric ion and a chelating agent (e.g., aminopolycarboxylic acid, aminopolyphosphonic acid or a salt thereof). The aminopolycarboxylic acid salts or aminopolyphosphonic acid salts are salts of aminopolycarboxylic or aminopolyphosphonic acid with an alkali metal, ammonium or water-soluble amine. The alkali metal includes sodium, potassium, lithium, etc., and the water-soluble amine includes alkylamines (e.g., methylamine, diethylamine, triethylamine, butylamine, etc.), cyclic amines (e.g., cyclohexylamine), arylamines (e.g., aniline, m-toluidine, etc.), and heterocyclic amines (e.g., pyridine, morpholine, piperidine, etc.).

Typical examples of the chelating agents of these aminopolycarboxylic acids, aminopolyphosphonic acids or the salts thereof are illustrated below which, however, are not intended to limit the scope of the present invention at all:

Ethylenediaminetetraacetic acid
Disodium ethylenediaminetetraacetate
Diammonium ethylenediaminetetraacetate
Tetra(trimethylammonium) ethylenediaminetetraacetate
Tetrapotassium ethylenediaminetetraacetate
Tetrasodium ethylenediaminetetraacetate
Trisodium ethylenediaminetetraacetate
Diethylenetriaminepentaacetic acid
Pentasodium diethylenetriaminepentaacetic
Ethylenediamine-N-(β-hydroxyethyl)-N,N',N'-triacetic acid
Trisodium ethylenediamine-N-(β-hydroxyethyl)-N,N',N'-triacetate
Triammonium ethylenediamine-N-(β-hydroxyethyl)-N,N',N'-triacetate
Propylenediaminetetraacetic acid
Disodium propylenediaminetetraacetate
Nitrilotriacetic acid
Trisodium nitrilotriacetate
Cyclohexanediaminetetraacetic acid
Disodium cyclohexanediaminetetraacetate
Iminodiacetic acid
Dihydroxyethylglycine
Ethyl ether diaminetetraacetic acid
Glycol ether diaminetetraacetic acid
Ethylenediaminetetrapropionic acid
Phenylenediaminetetraacetic acid
1,3-Diaminopropanol-N,N,N',N'-tetramethylenephosphonic acid
Ethylenediamine-N,N,N',N'-tetramethylenephosphonic acid
1,3-Propylenediamine-N,N,N',N'-tetramethylenephosphonic acid The ferric ion complexes may be used in the form of complex salts, or ferric salts such as ferric sulfate, ferric chloride, ferric nitrate, ferric ammonium sulfate or ferric secondary phosphate; chelating agents such as aminopolycarboxylic acid, aminopolyphosphonic acid or phosphonocarboxylic acid may be used to form the ferric complex salt in the solution. In the case of using the form of a complex salt, the complex salts may be used alone or as a combination of two or more. On the other hand, in the case of forming the complex salt in situ in the solution using the ferric salt and the chelating agent, the ferric salts may be used alone or in combination of two or more. Further, the chelating agents may be used alone or as a combination of two or more. In addition, in both cases, the chelating agent may be used in an excess amount over what is necessary for forming the ferric ion complex salt. Of the ferric complexes, ferric aminopolycarboxylates are preferred, and are added in an amount of about 0.01 to about 1.0 mol/liter, preferably 0.05 to 0.50 mol/liter.

A bleaching accelerator may be used in the bleaching or bleach-fixing solution; specific examples of useful bleaching accelerators are mercapto group- or disulfido group-containing compounds described in U.S. Pat. No. 3,893,858, West German Pat. Nos. 1,290,812 and 2,059,988, Japanese patent application (OPI) Nos. 32736/78, 57831/78, 37418/78, 65732/78, 72623/78, 95630/78, 95631/78, 104232/78, 124424/78, 141623/78, 28426/78, *Research Disclosure*, No. 17129 (July, 1978), etc., thiazolidine derivatives as described in Japanese patent application (OPI) No. 140129/75; thiourea derivatives described in Japanese Patent Publication No. 8506/70, Japanese patent application (OPI) Nos. 20832/77, 32735/78, and U.S. Pat. No. 3,706,561; iodides described in West German Patent No. 1,127,715 and Japanese Patent Application (OPI) No. 16235/83; polyethylene oxides described in West German Patent Nos. 966,410 and 2,748,430; polyamine compounds described in Japanese Patent Publication No. 8836/70; compounds described in Japanese patent application (OPI) Nos. 42434/74, 59644/74, 94927/78, 35727/79, 26506/80 and 163940/73; iodide or bromide ion; etc. Among these compounds, mercapto group- or disulfido group-containing compounds are preferred due to their great accelerating effect, and the compounds described in U.S. Pat. No. 3,893,858, West German Patent No. 1,290,812 and Japanese Patent Application (OPI) No. 95630/78 are particularly preferable.

Further, the bleaching or bleach-fixing solution of the present invention may contain a rehalogenating agent of bromide (e.g., potassium bromide, sodium bromide, ammonium bromide, etc.), chloride (e.g., potassium chloride, sodium chloride, ammonium chloride, etc.) or iodide (e.g., ammonium iodide). If necessary, one or more inorganic acids, organic acids, alkali metal salts or ammonium salts thereof, such as boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc. having a pH-buffering ability, or anti-corrosives such as ammonium nitrate and guanidine, may be added thereto.

Fixing agents to be used in the bleach-fixing or fixing solution of the present invention are known fixing agents, i.e., water-soluble silver halide-dissolving agents such as thiosulfates (e.g., sodium thiosulfate, ammonium thiosulfate, etc.), thiocyanates (e.g., sodium thiocyanate, ammonium thiocyanate, etc.), thioether compounds (e.g., ethylene-bis-thioglycolic acid, 3,6-dithia-1,8-octanediol, etc.), and thioureas. These may be used alone or in combination of two or more. Special bleach-fixing solutions comprising a combination of a fixing agent and a large amount of halide such as potassium iodides, as described in Japanese patent application (OPI) No. 155354/80, may also be used. In the present invention, the use of thiosulfates particularly ammonium thiosulfates, is preferred.

The amount of fixing agent ranges from about 013 to about 2 mols, preferably 0.5 to 1.0 mol, per liter.

One of the characteristic features of the present invention is that bleach-fixing is rapidly conducted for a time as short as 75 seconds or less, preferably not longer than 60 seconds.

The bleach-fixing solution or bleaching solution to be used in the present invention has a pH of preferably up to about 6.5, more preferably up to 6.0. The lower the pH, the more accelerated is the bleaching or bleach-fixing step. A high pH results in prolonged silver removal time, and stains are more likely to occur.

In order to adjust the pH, hydrochloric acid, sulfuric acid, nitric acid, acetic acid (glacial acetic acid), bicarbonates, ammonia, potassium hydroxide, sodium hydroxide, sodium carbonate, potassium carbonate, etc. may be added as the case demands.

The bleach-fixing solution may further contain various fluorescent brightening agents, defoaming agents, surfactants, polyvinyl pyrrolidone and organic solvents (e.g., methanol), as necessary.

The bleach-fixing or fixing solution of the present invention contains, as preservatives, sulfite ion-releasing compounds such as sulfites (e.g., sodium sulfite, potassium sulfite, ammonium sulfite, etc.), bisulfites (e.g., ammonium bisulfite, sodium bisulfite, potassium bisulfite, etc.), metabisulfite (e.g., potassium metabisulfite, sodium metabisulfite, ammonium metabisulfite, etc.), etc. These compounds are incorporated in an amount of preferably about 0.02 to about 0.50 mol/liter, more preferably 0.04 to 0.40 mol/liter, calculated as sulfite ion.

Sulfite salts are commonly added as preservatives. However, ascorbic cid, carbonyl-bisulfite adducts, carbonyl compounds, etc. may also be added.

Further, buffers, fluorescent brightening agents, chelating agents, antifungal agents, etc. may be added as the case demands.

The water-washing step employed in the photographic processing of the present invention is described below. A single step, i.e., conducting only "stabilizing processing" without providing a substantial water-washing step, may be employed in place of conventional "water-washing processing". Thus, the term "water-washing processing" as used herein in the present invention is used in a broad sense as including stabilization alone.

The amount of washing water to be used in the present invention is difficult to specify with particularity, since the amount depends upon the number of baths used for multi-stage countercurrent water washing, or upon the amount of components of light-sensitive materials carried over from the previous bath. In the present invention, however, it sufficed that the concentration of the components of the bleach-fixing solution in the final water-washing bath is controlled to about $1\times10^{-4}$ or less. For example, in the case of conducting 3-tank countercurrent water-washing, water is used in an amount of preferably about 1000 ml or more, more preferably 5000 ml or more, per $m^2$ of light-sensitive material to be processed. In a water-saving processing, water is used in an amount of preferably 100 to 1000 ml per $m^2$ of light-sensitive material.

The temperature of washing water ranges from about 15 to about 45° C., more preferably 20° to 35° C.

In the water-washing step, various known compounds may be added to the wash bath(s) for the purpose of preventing precipitation or stabilizing the washing water. For example, chelating agents (e.g., inorganic phosphoric acid, aminopolycarboxylic acids, organophosphonic acids, etc.), antibacterial agents and antifungal agents for preventing growth of various bacteria, algae, fungi, etc. (for example, those compounds which are described in *J. Antibact. Antifung. Agents*, Vol. 11, No. 5, pp. 207–223 (1983) and Hiroshi Horiguchi, *Bokin-bobai no Kagaku* (*Antibacterial and Antifungal Chemistry*), Sankyo Shuppan Co., Ltd., 1986), metal salts represented by magnesium salts and aluminum salts, alkali metal and ammonium salts, surfactants for reducing drying load or preventing drying unevenness, etc. may be added as the case demands. Alternatively, those compounds which are described in West, *Phot. Sci. Eng.*, Vol. 6, pp. 344–359 (1965), etc., may be added.

The present invention is particularly effective in the case of adding a chelating agent, an antibacterial agent, and an antifungal agent to a washing water and employing a multi-stage countercurrent water-washing step using two or more baths to greatly economize the amount of washing water required. In addition, this effect is particularly observed in the case of conducting multi-stage countercurrent stabilizing (so-called stabilizing processing) as described in Japanese patent application (OPI) No. 8543/82 in place of the conventional water-washing step. In these situations, it suffices to control the concentration of the bleach-fixing components in the final bath to be $5\times10^{-2}$ of less, preferably $1\times10^{-2}$ or less.

Various compounds are added to the stabilizing bath for the purpose of stabilizing the resulting images. For example, various buffers for adjusting film pH (to, for example, 3 to 8) (e.g., borates, metaborates, borax, phosphates, carbonates, potassium hydroxide, sodium hydroxide, aqueous ammonia, monocarboxylic acid, dicarboxylic acid, polycarboxylic acid, being used in a proper combination) and aldehydes (e.g., formalin) are typical buffers. In addition, various additives such as chelating agents (e.g., inorganic phosphoric acid, aminopolycarboxylic acids, organophosphonic acids, aminopolyphosphonic acids, phosphonocarboxylic acids, etc.), antibacterial agents (e.g., thiazoles, isothiazoles, halogenated phenols, sulfanylamides, benzotriazoles, etc.), surfactants, fluorescent brightening agents, hardeners, etc. may be used. Two or more of these compounds may be added for the same purpose or different purposes, as necessary.

It is preferable for improving image preservability to add various ammonium salts such as ammonium chloride, ammonium nitrate, ammonium sulfate, ammonium phosphate, ammonium sulfite, ammonium thiosulfate, etc. as film pH-adjusting agents.

For the purpose of greatly economizing the amount of washing water, it is preferred in view of reducing the amount of waste liquor to recycle all or a part of the overflow solution of washing water to the pre-bath of the bleach-fixing solution or the fixing solution.

In this processing step, a constant finish can be obtained by preventing fluctuation of solution composition using a replenisher for each processing solution. The replenishing amount may be reduced to a half of standard replenishing amounts or less for the purpose of reducing cost, etc.

Each processing bath may have, if necessary, a heater, a temperature sensor, a liquid level sensor, a circulating pump, a filter, various floating lids, various squeegees, nitrogen-stirring means, air-stirring means, etc.

The process of the present invention may be applied to any processing steps as long as a bleaching solution is ued. For example, the present invention may be applied to the processing of color paper, color reversal paper, color positive film, color negative film, color reversal film, etc.

The present invention is now described in greater detail by reference to the following examples which, however, are not to be construed as limiting the present invention in any manner. Unless otherwise indicated, all parts, percents, ratios and the like are by weight.

EXAMPLE 1

Silver halide emulsion (1) used in this example of the present invention was prepared as follows:

| | |
|---|---|
| (Solution 1) | |
| $H_2O$ | 1000 cc |
| NaCl | 5.5 g |
| Gelatin | 32 g |
| (Solution 2) | |
| Sulfuric acid (1 N) | 24 cc |
| (Solution 3) | |
| Silver halide solvent of the following structure (1%): | 3 cc |

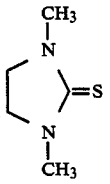

| | |
|---|---|
| (Solution 4) | |
| KBr | 15.66 g |
| NaCl | 3.30 g |
| $H_2O$ to make | 200 cc |
| (Solution 5) | |
| $AgNO_3$ | 32 g |
| $H_2O$ to make | 200 cc |
| (Solution 6) | |
| KBr | 62.72 g |
| NaCl | 13.22 g |
| $K_2IrCl_6$ (0.001%) | 4.54 cc |
| $H_2O$ to make | 600 cc |
| (Solution 7) | |
| $AgNO_3$ | 128 g |
| $H_2O$ to make | 600 cc |

(Solution 1) was heated to 56° C., and (Solution 2) and (Solution 3) were added thereto. Then, (Solution 4) and (Solution 5) were simultaneously added thereto over 30 minutes. After 10 minutes, (Solution 6) and (Solution 7) were simultaneously add thereto over 20 minutes. Five minutes after completion of the last addition, the temperature of the solution was lowered, followed by desalting. Water and dispersed gelatin were added thereto, and the pH of the solution was adjusted to 6.2 to obtain a monodispersed cubic silver chlorobromide emulsion having a mean grain size of 0.45 μm, a variation coefficient (value obtained by dividing standard deviation by mean grain size: s/d) of 0.08, and a silver bromide content of 70 mol %. $1.0\times10^{-4}$ mol/Ag of chloroauric acid and sodium thiosulfate were added thereto to conduct optimal chemical sensitization.

Then, silver halide emulsions (2), (3), (4), (5) and (6) having different silver chloride contents were prepared in the same manner as described above except for changing the amount of KBr and NaCl in (Solution 4) and (Solution 6), and the time of the addition (Solution 4) and (Solution 5) as sown in the following Table 1.

TABLE 1

| | (Solution 4) | | (Solution 6) | | Time of Addition (Solution 4) and |
|---|---|---|---|---|---|
| Emulsion | KBr | NaCl | KBr | NaCl | (Solution 5) |
| (2) | 6.71 g | 7.70 g | 26.88 g | 30.84 g | 12 minutes |
| (3) | 3.36 g | 9.35 g | 13.44 g | 37.44 g | 10 minutes |
| (4) | 1.12 g | 10.45 g | 4.48 g | 41.85 g | 9 minutes |
| (5) | 0.22 g | 10.89 g | 0.90 g | 43.61 g | 8 minutes |
| (6) | 0.00 g | 11.00 g | 0.00 g | 44.05 g | 8 minutes |

Mean grain size, variation coefficients, and halogen compositions of the silver halide emulsions (1) to (6) are tabulated in Table 2.

TABLE 2

| Emulsion | Mean Grain Size (μm) | Variation Coefficient (s/d̄) | Halogen Composition (%) Br | Cl | Remarks |
|---|---|---|---|---|---|
| (1) | 0.45 | 0.08 | 70 | 30 | For comparison |
| (2) | 0.45 | 0.07 | 30 | 70 | " |
| (3) | 0.45 | 0.07 | 15 | 85 | Present Invention |
| (4) | 0.45 | 0.08 | 5 | 95 | " |
| (5) | 0.45 | 0.08 | 1 | 99 | " |
| (6) | 0.45 | 0.08 | 0 | 100 | " |

Then, 13.6 ml of ethyl acetate and 10.0 ml of solvent (c) were added to 10.0 g of magenta coupler (a) and 4.1 g of color image stabilizer (b) to prepare a solution. This solution was emulsified and dispersed in 150 ml of a 10% gelatin aqueous solution containing 10 ml of 10% sodium dodecylbenzenesulfonate.

The samples shown in Table 3 were prepared by combining the previously prepared emulsions (1) to (6), respectively, containing the compounds shown in Table 3 and the above-described emulsion dispersion. Further, the samples shown in Table 4 were prepared by combining the previously prepared emulsions respectively containing the compounds shown in Table 4, $5.0\times10^{-4}$ mol of 1-(3-acetylaminophenyl)-5-mercaptotetrazole (d) per mol of silver halide, and optionally $3\times10^{-3}$ mol of potassium bromide per mol of silver halide and the above-described emulsion dispersion.

As the support, paper supports double-laminated with polyethylene were used. The amount of the coating solution was selected so that the amount of silver became 0.15 g/m², the amount of the coupler became 0.38 g/m², and the amount of gelatin became 1.80 g/m². A protective layer of 1.50 g/m² of gelatin was provided as an uppermost layer. As a gelatin hardener, 1-hydroxy-3,5-dichloro-s-triazine sodium salt was used in each layer.

(a) Magenta coupler

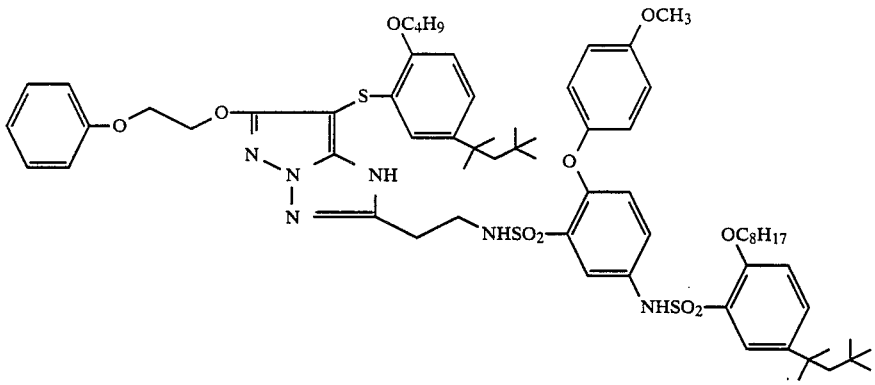

(b) Color image stabilizer

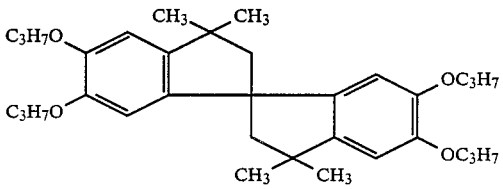

(c) Solvent

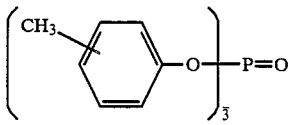

(d) Antifoggant

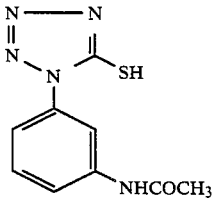

TABLE 3

| Sample No. | Emulsion No. | Added Compound Kind | Added Compound Amount (mol/mol AgX) |
|---|---|---|---|
| 3-1 | (1) | (A)* | $5.2 \times 10^{-4}$ |
| 3-2 | (2) | " | " |
| 3-3 | (3) | " | " |
| 3-4 | (4) | " | " |
| 3-5 | (5) | " | " |
| 3-6 | (6) | " | " |
| 3-7 | (1) | I-6 | $5.2 \times 10^{-4}$ |
| 3-8 | (2) | " | " |
| 3-9 | (3) | " | " |
| 3-10 | (4) | " | " |
| 3-11 | (5) | " | " |
| 3-12 | (6) | " | " |
| 3-13 | (1) | I-3 | $5.5 \times 10^{-4}$ |
| 3-14 | (5) | " | " |
| 3-15 | (1) | I-9 | $5.2 \times 10^{-4}$ |
| 3-16 | (6) | " | " |
| 3-17 | (4) | (C) | $6.0 \times 10^{-4}$ |
| 3-18 | (6) | " | " |
| 3-19 | (6) | III-4 | $6.0 \times 10^{-4}$ |
| 3-20 | (6) | III-7 | $6.0 \times 10^{-4}$ |

TABLE 3-continued

| Sample No. | Emulsion No. | Added Compound Kind | Added Compound Amount (mol/mol AgX) |
|---|---|---|---|
| 3-21 | (5) | III-8 | $6.0 \times 10^{-4}$ |
| 3-22 | (4) | III-33 | $6.0 \times 10^{-4}$ |
| 3-23 | (6) | " | " |
| 3-24 | (1) | (B)* | $3.5 \times 10^{-4}$ |
| 3-25 | (3) | " | " |
| 3-26 | (4) | " | " |
| 3-27 | (6) | " | " |
| 3-28 | (1) | II-6 | $3.5 \times 10^{-4}$ |
| 3-29 | (3) | " | " |
| 3-30 | (4) | " | " |
| 3-31 | (6) | " | " |
| 3-32 | (2) | II-8 | $1.8 \times 10^{-4}$ |
| 3-33 | (6) | " | " |
| 3-34 | (1) | II-23 | $4.0 \times 10^{-4}$ |
| 3-35 | (3) | " | " |

TABLE 3-continued

| Sample No. | Emulsion No. | Added Compound Kind | Added Compound Amount (mol/mol AgX) |
|---|---|---|---|
| 3-36 | (6) | " | " |

*Comparative compounds (A), (B) and (C) have the following structures:

Comparative Compound (A):

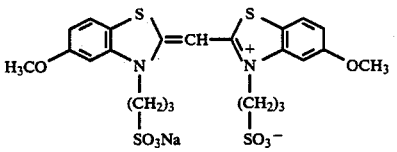

Comparative Compound (B):

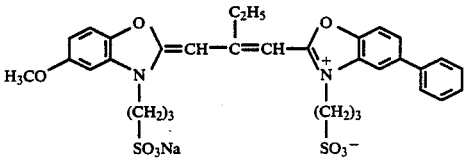

Comparative Compound (C)

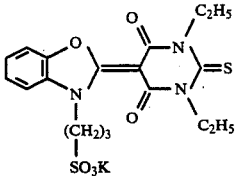

TABLE 4

| Sample No. | Used Emulsion | Added Compound Kind | Added Compound Amount (mol/mol AgX) | Addition of KBr | Remarks |
|---|---|---|---|---|---|
| 4-1 | (1) | (D)* | $5.0 \times 10^{-4}$ | yes | For comparison |
| 4-2 | (3) | " | " | " | For comparison |
| 4-3 | (4) | " | " | " | For comparison |
| 4-4 | (6) | " | " | " | For comparison |
| 4-5 | (1) | I-12 | $5.0 \times 10^{-4}$ | yes | |
| 4-6 | (3) | " | " | " | |
| 4-7 | (4) | " | " | " | |
| 4-8 | (6) | " | " | " | |
| 4-9 | (3) | I-2 | $5.0 \times 10^{-4}$ | no | |
| 4-10 | (6) | " | " | yes | |
| 4-11 | (4) | III-16 | $5.5 \times 10^{-4}$ | no | |
| 4-12 | (5) | " | " | " | |
| 4-13 | (6) | " | " | " | |
| 4-14 | (1) | (E)* | $4.0 \times 10^{-4}$ | yes | For comparison |
| 4-15 | (4) | " | " | " | For comparison |
| 4-16 | (6) | " | " | " | For comparison |
| 4-17 | (1) | II-23 | $4.0 \times 10^{-4}$ | yes | |
| 4-18 | (4) | " | " | " | |
| 4-19 | (6) | " | " | " | |
| 4-20 | (4) | II-18 | $2.0 \times 10^{-4}$ | no | |
| 4-21 | (5) | " | " | " | |
| 4-22 | (4) | III-34 | $3.5 \times 10^{-4}$ | no | |
| 4-23 | (6) | " | " | " | |

TABLE 4-continued

| Sample No. | Used Emulsion | Added Compound Kind | Added Compound Amount (mol/mol AgX) | Addition of KBr | Remarks |
|---|---|---|---|---|---|
| 4-24 | (6) | III-24 | $1.0 \times 10^{-4}$ | yes | |

*Compounds (D) and (E) have the following structure:

Compound (D)

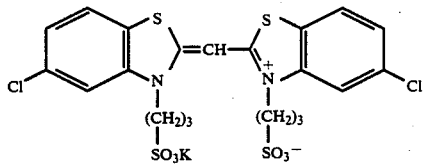

Compound (E)

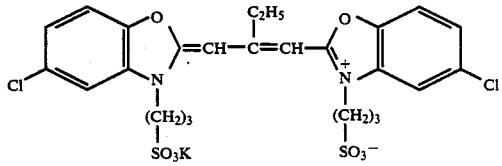

The above-described samples 3-1 to 3-40 and 4-1 to 4-24 were subjected to gradation exposure for sensitometry using a sensitometer (model FWH; made by Fuji Photo Film Co., Ltd.; color temperature: 3,200° K.), with samples 3-1 to 3-23 and 4-1 to 4-13 through sharp-cut filter No. 42 made by Fuji Photo Film Co., Ltd., and samples 3-24 to 3-26 and 4-14 to 4-24 through sharp-cut filter No. 48. This exposure was conducted so that a 0.5-second exposure gave an exposure amount of 250 CMS.

Then, processing A and B were respectively conducted using color developers (A) and (B) described hereinafter.

Each of the processing comprises the steps of color development, bleach-fixing, and rinsing. In processing A, developing time was 3 minutes and 30 seconds, and the results were used as a standard for confirming the effects of the present invention. In processing B, developing time was changed to 30 seconds or 60 seconds to evaluate photographic properties. The specifics of processings A and B are as described hereinafter.

Photographic properties were evaluated in terms of fog density (Dmin), relative spectral sensitization ratio, and color-forming properties. The relative spectral sensitization ratio was determined as follows. A reciprocal of an exposure amount necessary for providing a density of fog +0.5 was used as a sensitivity. Each of the formerly prepared emulsions (not containing the compounds shown in Tables 3 and 4) was combined with each of the emulsion dispersions to prepare 6 samples in the same manner as with the samples shown in Tables 3 and 4, and each sample was exposed in the same manner as described above through an ultraviolet ray-transmitting and visible light-absorbing filter, UV-D33S, made by Toshiba Glass Co., Ltd. and was developed for 3 minutes and 30 seconds using processing A. The difference between the thus-measured sensitivity and that obtained by using the corresponding emulsion was used as the spectral sensitization ratio. The spectral sensitization ratios of Samples 3-1 to 3-23 were relatively evaluated using the value of Sample 3-1 as 100, and those of samples 3-24 to 3-26 were relatively evaluated using the value of Sample 3-24 as 100, those of Samples 4-1 to 4-13 were relatively evaluated using the value of Sample 4-1 as 100, and those of Samples 4-14 to 4-24 were relatively evaluated using the value of Sample 4-14 as 100.

In order to evaluate rapidity of development, 3 minutes and 30 seconds processing according to processing A was also used as a standard. That is, an exposure amount necessary for providing a color density of 1.50 in the 3 minutes and 30 seconds processing according to processing A was determined as to each light-sensitive material, and color density obtained by each processing was used as a measure for color-forming properties.

The results thus obtained are shown in Tables 5 and 6.

TABLE 5-1

| | Processing A | | | | Processing B | | | |
|---|---|---|---|---|---|---|---|---|
| Sample No. | Development Time | Dmin | 1* | Color Forming Property | Development Time | Dmin | 1* | Color Forming Property |
| 3-1 | 3 min 30 sec | 0.10 | 100 (Standarad) | 1.5 | 30 sec. | 0.10 | 68 | 1.15 |
| | | | | | 60 sec. | 0.10 | 93 | 1.42 |
| 3-2 | " | 0.10 | 79 | " | 30 sec. | 0.10 | 56 | 1.24 |
| | | | | | 60 sec. | 0.10 | 75 | 1.42 |
| 3-3 | " | 0.11 | 60 | " | 30 sec. | 0.10 | 47 | 1.35 |
| | | | | | 60 sec. | 0.12 | 60 | 1.52 |
| 3-4 | " | 0.12 | 56 | " | 30 sec. | 0.11 | 48 | 1.44 |
| | | | | | 60 sec. | 0.14 | 58 | 1.60 |
| 3-5 | " | 0.16 | 44 | " | 30 sec. | 0.11 | 44 | 1.48 |
| | | | | | 60 sec. | 0.16 | 48 | 1.62 |
| 3-6 | " | 0.17 | 42 | " | 30 sec. | 0.13 | 42 | 1.52 |
| | | | | | 60 sec. | 0.17 | 47 | 1.66 |
| 3-7 | " | 0.10 | 190 | " | 30 sec. | 0.08 | 129 | 1.16 |
| | | | | | 60 sec. | 0.09 | 181 | 1.42 |
| 3-8 | " | 0.10 | 200 | " | 30 sec. | 0.08 | 148 | 1.26 |
| | | | | | 60 sec. | 0.10 | 196 | 1.44 |
| 3-9 | " | 0.11 | 224 | " | 30 sec. | 0.09 | 186 | 1.36 |
| | | | | | 60 sec. | 0.10 | 226 | 1.51 |
| 3-10 | " | 0.11 | 240 | " | 30 sec. | 0.09 | 223 | 1.45 |
| | | | | | 60 sec. | 0.11 | 264 | 1.60 |
| 3-11 | 3 min 30 sec. | 0.13 | 268 | 1.5 | 30 sec. | 0.10 | 273 | 1.54 |
| | | | | | 60 sec. | 0.11 | 308 | 1.67 |
| 3-12 | " | 0.15 | 288 | " | 30 sec. | 0.13 | 302 | 1.55 |
| | | | | | 60 sec. | 0.15 | 337 | 1.67 |
| 3-13 | " | 0.10 | 87 | " | 30 sec. | 0.10 | 62 | 1.14 |
| | | | | | 60 sec. | 0.10 | 81 | 1.43 |
| 3-14 | " | 0.16 | 105 | " | 30 sec. | 0.10 | 107 | 1.56 |
| | | | | | 60 sec. | 0.15 | 121 | 1.70 |
| 3-15 | " | 0.10 | 79 | " | 30 sec. | 0.10 | 54 | 1.15 |
| | | | | | 60 sec. | 0.10 | 73 | 1.42 |
| 3-16 | " | 0.16 | 270 | " | 30 sec. | 0.11 | 284 | 1.56 |
| | | | | | 60 sec. | 0.16 | 310 | 1.68 |
| 3-17 | " | 0.13 | 45 | " | 30 sec. | 0.10 | 38 | 1.43 |
| | | | | | 60 sec. | 0.14 | 47 | 1.58 |
| 3-18 | " | 0.18 | 28 | " | 30 sec. | 0.12 | 28 | 1.50 |
| | | | | | 60 sec. | 0.18 | 31 | 1.65 |
| 3-19 | " | 0.16 | 338 | " | 30 sec. | 0.11 | 355 | 1.58 |
| | | | | | 60 sec. | 0.16 | 395 | 1.71 |
| 3-20 | " | 0.16 | 107 | " | 30 sec. | 0.10 | 109 | 1.56 |
| | | | | | 60 sec. | 0.15 | 123 | 1.68 |
| 3-21 | 3 min 30 sec | 0.16 | 89 | 1.5 | 30 sec. | 0.11 | 91 | 1.54 |
| | | | | | 60 sec. | 0.16 | 98 | 1.64 |
| 3-22 | " | 0.11 | 276 | " | 30 sec. | 0.10 | 1092 | 1.41 |
| | | | | | 60 sec. | 0.13 | 1256 | 1.58 |
| 3-23 | " | 0.15 | 1116 | " | 30 sec. | 0.10 | 1172 | 1.54 |
| | | | | | 60 sec. | 0.15 | 1283 | 1.62 |
| 3-24 | " | 0.10 | 100 | " | 30 sec. | 0.10 | 68 | 1.13 |
| | | | | | 60 sec. | 0.10 | 95 | 1.44 |
| 3-25 | " | 0.11 | 25 | " | 30 sec. | 0.10 | 20 | 1.23 |
| | | | | | 60 sec. | 0.13 | 25 | 1.44 |
| 3-26 | " | 0.14 | 17 | " | 30 sec. | 0.12 | 14 | 1.43 |
| | | | | | 60 sec. | 0.15 | 18 | 1.56 |
| 3-27 | " | 0.17 | 16 | " | 30 sec. | 0.12 | 16 | 1.51 |
| | | | | | 60 sec. | 0.18 | 18 | 1.62 |
| 3-28 | " | 0.10 | 125 | " | 30 sec. | 0.10 | 85 | 1.17 |
| | | | | | 60 sec. | 0.10 | 119 | 1.48 |
| 3-29 | " | 0.11 | 117 | " | 30 sec. | 0.10 | 99 | 1.38 |
| | | | | | 60 sec. | 0.13 | 119 | 1.55 |
| 3-30 | " | 0.12 | 115 | " | 30 sec. | 0.10 | 102 | 1.47 |
| | | | | | 60 sec. | 0.14 | 127 | 1.62 |
| 3-31 | 3 min 30 sec. | 0.16 | 110 | 1.5 | 30 sec. | 0.10 | 116 | 1.55 |
| | | | | | 60 sec. | 0.16 | 129 | 1.68 |
| 3-32 | " | 0.11 | 160 | " | 30 sec. | 0.10 | 118 | 1.24 |
| | | | | | 60 sec. | 0.11 | 157 | 1.43 |
| 3-33 | " | 0.16 | 145 | " | 30 sec. | 0.12 | 152 | 1.58 |
| | | | | | 60 sec. | 0.16 | 167 | 1.71 |
| 3-34 | " | 0.10 | 112 | " | 30 sec. | 0.10 | 76 | 1.14 |
| | | | | | 60 sec. | 0.10 | 104 | 1:47 |
| 3-35 | " | 0.11 | 50 | " | 30 sec. | 0.10 | 41 | 1.30 |
| | | | | | 60 sec. | 0.11 | 51 | 1.52 |

TABLE 5-1-continued

| Sample No. | Processing A Development Time | Dmin | 1* | Color Forming Property | Processing B Development Time | Dmin | 1* | Color Forming Property |
|---|---|---|---|---|---|---|---|---|
| 3-36 | " | 0.17 | 14 | " | 30 sec. | 0.13 | 14 | 1.54 |
| | | | | | 60 sec. | 0.17 | 15 | 1.62 |

1*: Relative spectral sensitization ratio

TABLE 6-1

| Sample No. | Processing A Development Time | Dmin | 1* | Color Forming Property | Processing B Development Time | Dmin | 1* | Color Froming Property |
|---|---|---|---|---|---|---|---|---|
| 4-1 | 3 min 30 sec. | 0.08 | 100 (Standard) | 1.5 | 30 sec. | 0.08 | 66 | 1.09 |
| | | | | | 60 sec. | 0.08 | 89 | 1.40 |
| 4-2 | " | 0.09 | 85 | " | 30 sec. | 0.08 | 67 | 1.33 |
| | | | | | 60 sec. | 0.09 | 83 | 1.48 |
| 4-3 | " | 0.10 | 71 | " | 30 sec. | 0.09 | 60 | 1.41 |
| | | | | | 60 sec. | 0.10 | 72 | 1.56 |
| 4-4 | " | 0.13 | 69 | " | 30 sec. | 0.11 | 69 | 1.50 |
| | | | | | 60 sec. | 0.13 | 77 | 1.64 |
| 4-5 | " | 0.08 | 213 | " | 30 sec. | 0.08 | 151 | 1.13 |
| | | | | | 60 sec. | 0.08 | 202 | 1.42 |
| 4-6 | " | 0.09 | 237 | " | 30 sec. | 0.09 | 197 | 1.35 |
| | | | | | 60 sec. | 0.09 | 242 | 1.52 |
| 4-7 | " | 0.10 | 281 | " | 30 sec. | 0.09 | 261 | 1.43 |
| | | | | | 60 sec. | 0.10 | 309 | 1.58 |
| 4-8 | " | 0.12 | 398 | " | 30 sec. | 0.11 | 406 | 1.51 |
| | | | | | 60 sec. | 0.12 | 458 | 1.65 |
| 4-9 | " | 0.09 | 231 | " | 30 sec. | 0.08 | 192 | 1.34 |
| | | | | | 60 sec. | 0.09 | 231 | 1.53 |
| 4-10 | " | 0.12 | 302 | " | 30 sec. | 0.11 | 308 | 1.53 |
| | | | | | 60 sec. | 0.13 | 338 | 1.63 |
| 4-11 | 3 min 30 sec. | 0.10 | 107 | 1.5 | 30 sec. | 0.10 | 97 | 1.42 |
| | | | | | 60 sec. | 0.10 | 114 | 1.57 |
| 4-12 | " | 0.12 | 110 | " | 30 sec. | 0.11 | 112 | 1.52 |
| | | | | | 60 sec. | 0.12 | 123 | 1.63 |
| 4-13 | " | 0.13 | 110 | " | 30 sec. | 0.12 | 116 | 1.53 |
| | | | | | 60 sec. | 0.14 | 127 | 1.65 |
| 4-14 | " | 0.08 | 63 | " | 30 sec. | 0.08 | 63 | 1.16 |
| | | | | | 60 sec. | 0.08 | 87 | 1.41 |
| 4-15 | " | 0.11 | 35 | " | 30 sec. | 0.10 | 52 | 1.25 |
| | | | | | 60 sec. | 0.11 | 63 | 1.43 |
| 4-16 | " | 0.15 | 35 | " | 30 sec. | 0.10 | 35 | 1.36 |
| | | | | | 60 sec. | 0.16 | 37 | 1.57 |
| 4-17 | " | 0.08 | 125 | " | 30 sec. | 0.07 | 83 | 1.17 |
| | | | | | 60 sec. | 0.08 | 116 | 1.42 |
| 4-18 | " | 0.10 | 141 | " | 30 sec. | 0.09 | 131 | 1.47 |
| | | | | | 60 sec. | 0.11 | 151 | 1.61 |
| 4-19 | " | 0.12 | 170 | " | 30 sec. | 0.10 | 179 | 1.53 |
| | | | | | 60 sec. | 0.12 | 196 | 1.68 |
| 4-20 | " | 0.10 | 165 | " | 30 sec. | 0.09 | 153 | 1.42 |
| | | | | | 60 sec. | 0.10 | 177 | 1.57 |
| 4-21 | 3 min 30 sec. | 0.12 | 190 | 1.5 | 30 sec. | 0.10 | 194 | 1.51 |
| | | | | | 60 sec. | 0.12 | 213 | 1.64 |
| 4-22 | " | 0.10 | 207 | " | 30 sec. | 0.10 | 188 | 1.43 |
| | | | | | 60 sec. | 0.10 | 217 | 1.58 |
| 4-23 | " | 0.14 | 233 | " | 30 sec. | 0.12 | 245 | 1.54 |
| | | | | | 60 sec. | 0.14 | 268 | 1.66 |
| 4-24 | " | 0.12 | 165 | " | 30 sec. | 0.11 | 168 | 1.52 |
| | | | | | 60 sec. | 0.13 | 185 | 1.64 |

| Processing Step | Temperature | Time |
|---|---|---|
| Development A | 33° C. | 3'30" |
| Development B | 35° C. | 30"-60" |
| Bleach-fixing A | 33° C. | 1'30" |
| Bleach-fixing B | 35° C. | 45" |
| Rinsing | 28-35° C. | 1'30" |

Compositions of development solutions:

Color developer A

| | |
|---|---|
| Pentasodium diethylenetriamine-pentaacetate | 2.0 g |
| Benzyl alcohol | 15 ml |
| Diethylene glycol | 10 ml |
| $Na_2SO_3$ | 2.0 g |
| KBr | 1.0 g |
| Hydroxylamine sulfate | 3.0 g |
| 5-Amino-3-methyl-N—ethyl-N—(β- | |

TABLE 6-1-continued

| | |
|---|---|
| (methanesulfonamido)ethyl)-p-phenylenediamine sulfate | 5.0 g |
| $Na_2CO_3$ (monohydrate) | 30.0 g |
| Fluorescent brightening agent (stilbene type) | 1.0 g |
| Water to make | 1000 ml (pH 10.2) |
| Color developer B | |
| Water | 800 cc |
| Diethylenetriaminepentaacetic acid | 1.0 g |
| Sodium sulfite | 2.0 g |
| N,N—Diethylhydroxylamine | 4.2 g |
| Potassium bromide | 0.01 g |
| Sodium chloride | 1.5 g |
| Triethanolamine | 8.0 g |
| Potassium carbonate | 30.0 g |
| N—Ethyl-N—(β-methanesulfonamido-ethyl)-3-methyl-4-aminoaniline sulfate | 4.5 g |
| 4,4'-Diaminostilbene type fluorescent brightening agent (Whitex 4; a trade name, made by Sumitomo Chemical Co., Ltd.) | 2.0 g |
| Water to make | 1000 cc |
| pH was adjusted to 10.22 with KOH | |
| Composition of bleach-fixing solution: | |
| Ammonium thiosulfate (54 wt %) | 150 ml |
| $Na_2SO_3$ | 15 g |
| $NH_4$(Fe(III)(EDTA)) | 55 g |
| EDTA.2Na | 4 g |
| Glacial acidic acid | 8.61 g |
| Water to make | 1000 ml (pH 5.4) |
| Composition of rinsing solution: | |
| EDTA.2Na.$2H_2O$ | 0.4 g |
| Water to make | 1000 ml (pH 7.0) |

1*: Relative spectral sensitization ratio

As is clear from the results tabulated above, high spectral sensitization ratios can be obtained according to the present invention even when high silver chloride emulsions are used. In addition, even when rapid processing is conducted using a benzyl alcohol-free color developer, there is obtained a spectral sensitization ratio and a high color density as high as in the case of processing for a developing time of 3 minutes and 30 seconds using a benzyl alcohol-containing developer. The comparative compounds are taught as effective compounds even in high silver chloride emulsions by Japanese patent application (OPI) No. 106538/83 (U.S. Pat. No. 4,469,785), etc. However, the comparative compounds exhibited an extremely low spectral sensitization ratio in the high silver chloride emulsions employed in the present invention. Thus, those compounds which have conventionally been effectively used for emulsions mainly comprising silver bromide are not necessarily applicable to high silver chloride emulsions, and it is also been that only sensitizing dyes represented by formula (I), (II) or (III) in accordance with the present invention are effective.

Compound II-23 cannot be said to be effective by comparing the results with Samples 3-35 and 3-36 in Table 5-2. However, the results of Samples 4-18 and 4-19 in Table 6-2 reveal the effectiveness of this compound. That is, when used in combination with a slight amount of KBr, this compound provides a high spectral sensitization ratio to even a pure silver chloride emulsion (it is apparent that combined use with KBr does not always give a high spectral sensitization ratio, as is seen by comparing the results of Samples 4-3, 4-4, 4-15 and 4-16 using compounds outside the scope of the present invention shown in Table 6-2) and, in the processing using a benzyl alcohol-free color developer, this dye provides a high coloration density in a short time without prolongation of development. It is also seen from the results shown in Table 6 that combined use with compound (d), which is one example of a mercaptoazole compound, serves to effectively reduce fog together with the slight amount of KBr without adversely affecting sensitivity and coloring properties.

Silver removability was evaluated as follows. Some of the above-described samples were processed at 35° C. for 60 seconds with color developer (B), then for 25 seconds or 45 seconds with the above-described bleach-fixing solution (referred to as Solution Blix-1) or with a solution prepared by adding sodium hydroxide to this bleach-fixing solution to adjust the pH to 7.0 (referred to as Solution Blix-2), then processed in the same manner as in the case of obtaining the above-described results such as rinsing etc. Exposure was conducted using the above-described sensitometer in such manner that the processing B gave a color density of 1.5.

Silver removability was evaluated by visual observation in four levels. Evaluation standard was as follows. Results thus obtained are shown in Table 7.

1. A level of silver deposit was observed in such an amount that the sample is unable to be practically used (in this case, 20% or more of coated silver remains).

2. A level of silver deposit was observed under intense scrutiny, and color stain ws slightly observed, thus being practically unfavorable.

3. A level of no silver deposit was observed under intense scrutiny, and color stain was only very slightly observed in comparison with a perfectly good sample.

4. A perfectly good level for all practical purposes.

TABLE 7-1

| Sample No. | Blix-1 (pH 5.4) Processing Time | Blix-1 (pH 5.4) Silver Removability | Blix-2 (pH 7.0) Processing Time | Blix-2 (pH 7.0) Silver Removability |
|---|---|---|---|---|
| 3-1 | 25 sec | 4 | 25 sec | 2 |
| | 45 sec | | 45 sec | |
| 3-4 | 25 sec | 4 | 25 sec | 3 |
| | 45 sec | | 45 sec | |
| 3-5 | 25 sec | 3 | 25 sec | 1 |
| | 45 sec | | 45 sec | |
| 3-6 | 25 sec | 4 | 25 sec | 2 |
| | 45 sec | | 45 sec | |
| 3-8 | 25 sec | 2 | 25 sec | 1 |
| | 45 sec | | 45 sec | |
| 3-9 | 25 sec | 3 | 25 sec | 1 |
| | 45 sec | | 45 sec | |
| 3-10 | 25 sec | 2 | 25 sec | 1 |
| | 45 sec | | 45 sec | |
| 3-12 | 25 sec | 2 | 25 sec | 1 |
| | 45 sec | | 45 sec | |
| 3-14 | 25 sec | 4 | 25 sec | 2 |
| | 45 sec | | 45 sec | |
| 3-16 | 25 sec | 4 | 25 sec | 3 |
| | 45 sec | | 45 sec | |
| 3-18 | 25 sec | 2 | 25 sec | 1 |
| | 45 sec | 2 | 45 sec | 1 |
| 3-19 | 25 sec | 3 | 25 sec | 1 |
| | 45 sec | 4 | 45 sec | 2 |
| 3-20 | 25 sec | 4 | 25 sec | 1 |
| | 45 sec | 4 | 45 sec | 2 |
| 3-22 | 25 sec | 3 | 25 sec | 1 |
| | 45 sec | 4 | 45 sec | 1 |
| 3-23 | 25 sec | 3 | 25 sec | 1 |
| | 45 sec | 4 | 45 sec | 2 |
| 3-24 | 25 sec | 3 | 25 sec | 2 |
| | 45 sec | 4 | 45 sec | 2 |
| 3-27 | 25 sec | 2 | 25 sec | 1 |
| | 45 sec | 3 | 45 sec | 1 |
| 3-30 | 25 sec | 4 | 25 sec | 1 |
| | 45 sec | 4 | 45 sec | 2 |
| 3-31 | 25 sec | 4 | 25 sec | 1 |
| | 45 sec | 4 | 45 sec | 2 |
| 3-33 | 25 sec | 4 | 25 sec | 1 |
| | 45 sec | 4 | 45 sec | 2 |
| 4-4 | 25 sec | 2 | 25 sec | 1 |
| | 45 sec | 3 | 45 sec | 1 |
| 4-10 | 25 sec | 4 | 25 sec | 1 |
| | 45 sec | 4 | 45 sec | 1 |
| 4-16 | 25 sec | 1 | 25 sec | 1 |
| | 45 sec | 2 | 45 sec | 1 |
| 4-19 | 25 sec | 3 | 25 sec | 1 |
| | 45 sec | 3 | 45 sec | 1 |

As is clear from the results shown in Table 7, an increased silver chloride content tends to result in a more deteriorated silver removability. However, silver removability was improved by bleaching under the bleach-fixing conditions of the present invention. The sensitizing dyes of the present invention gave good silver removability, whereas samples using sensitizing dyes outside the scope of the present invention gave insufficient silver removability. It was extremely unexpected that the sensitizing dyes having the specific structure of formula (I), (II) or (III) provided a high spectral sensitization effect as has been shown hereinbefore and, at the same time, provided good silver removability to high silver chloride emulsions when processed under the specific conditions of the present invention. Thus, the present invention is extremely valuable for providing silver halide color photographic materials having high sensitivity and capable of being rapidly processed.

EXAMPLE 2

Silver halide emulsion (7) used in this example was prepared as follows.

| | |
|---|---|
| (Solution 8) | |
| $H_2O$ | 1000 cc |
| NaCl | 5.5 g |
| Gelatin | 32 g |
| (Solution 9) | |
| Sulfuric acid (1N) | 20 cc |
| (Solution 10) | |
| Silver halide solvent of the following structure (1%): | 3 cc |

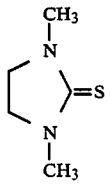

| | |
|---|---|
| (Solution 11) | |
| KBr | 2.45 g |
| NaCl | 0.52 g |
| $H_2O$ to make | 140 cc |
| (Solution 12) | |
| $AgNO_3$ | 5 g |
| $H_2O$ to make | 140 cc |
| (Solution 13) | |
| KBr | 58.80 g |
| NaCl | 12.39 g |
| $K_2IrCl_6$ (0.001%) | 0.7 cc |
| $H_2O$ to make | 320 cc |
| (Solution 14) | |
| $AgNO_3$ | 120 g |
| $H_2O$ to make | 320 cc |

(Solution 8) was heated to 75° C., and (Solution 9) and (Solution 10) were added thereto. Then, (Solution 11) and (Solution 12) were simultaneously added thereto over 9 minutes. After 10 minutes, (Solution 13) and (Solution 14) were simultaneously added thereto over 45 minutes. After 5 minutes, the temperature was lowered, followed by desalting. Water and a dispersed gelatin were added thereto, and the pH was adjusted to 6.2 to obtain a monodispersed cubic silver chlorobromide emulsion having a mean grain size of 1.01 μm, a variation coefficient (value calculated by dividing standard deviation by mean grain size: $s/\bar{d}$) of 0.08, and a silver bromide content of 70 mol %. $1\times10^{-4}$ mol/mol Ag of chloroauric acid and sodium thiosulfate were added thereto to conduct optimal chemical sensitization.

Then, silver halide emulsions (8) and (9) having different silver chloride contents were also prepared in the same manner, except for changing the temperature of (Solution 8) to 62° C., changing the composition to (Solution 11) to (Solution 14), and changing the time required for adding (Solution 11) and (Solution 12) or (Solution 13) and (Solution 14) as shown in Tables 8 and 9, respectively.

TABLE 8

| Emulsion | Solution-11 KBr | Solution-11 NaCl | Solution-11 $H_2O$ to make | Solution-12 $AgNO_3$ | Solution-12 $NH_4NO_3$ (50%) | Solution-12 $H_2O$ to make | Time for adding Solution-11 and Solution-12 |
|---|---|---|---|---|---|---|---|
| (8) | 2.63 g | 7.31 g | 130 cc | 25 g | 0.5 cc | 130 cc | 60 minutes |
| (9) | 0.18 g | 8.51 g | 130 cc | 25 g | 0.5 cc | 130 cc | 60 minutes |

TABLE 9

| Emulsion | Solution-13 KBr | Solution-13 NaCl | Solution-13 $K_2IrCl$ (0.001%) | Solution-13 $H_2O$ to make | Solution-14 $AgNO_3$ | Solution-14 $NH_4NO_3$ (50%) | Solution-14 $H_2O$ to make | Time for adding Solution-13 and Solution-14 |
|---|---|---|---|---|---|---|---|---|
| (8) | 10.51 g | 29.24 g | 0.7 cc | 285 cc | 100 g | 2.0 cc | 285 cc | 25 minutes |
| (9) | 0.70 g | 34.06 g | 0.7 cc | 285 cc | 100 g | 2.0 cc | 285 cc | 25 minutes |

The mean grain size, variation coefficients, and halogen compositions of silver halide emulsion (7) to (9) are shown in Table 10.

TABLE 10

| Emulsion | Mean Grain Size (μm) | Variation Coefficient (s/d) | Halogen Composition (%) Br | Halogen Composition (%) Cl | Remarks |
|---|---|---|---|---|---|
| (7) | 1.01 | 0.08 | 70 | 30 | For comparison |
| (8) | 1.01 | 0.07 | 15 | 85 | Present Invention |
| (9) | 1.02 | 0.08 | 1 | 99 | Present Invention |

Silver halide emulsions (1), (3), (5), (7), (8) and (9) and the color coupler emulsion dispersions described below, and the compounds in accordance with the present invention were properly combined to prepare Samples 5-1 to 5-7 shown in Tables 11 and 12.

In this example, Compound I-9 was added to an emulsion for a blue-sensitive layer in an amount of $7.0\times10^{-4}$ mol per mol of silver halide, Compound II-6 was added to an emulsion for a green-sensitive layer in an amount of $4.0\times10^{-4}$ mol per mol of silver halide, and sensitizing dye (v) was added to an emulsion for a red-sensitive layer in an amount of $1.0\times10^{-4}$ mol per mol of silver halide.

As irradiation-preventing agents for respective layers, the following compounds (e) and (f) were used. As a gelatin hardener for each layer, the same hardener as used in Example 1 was used. a, b, and c in Table 11 represents the same compounds as in Example 1.

(e) Green-Sensitive Emulsion Layer:

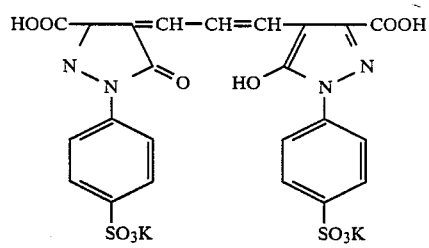

(f) Red-Sensitive Emulsion Layer:

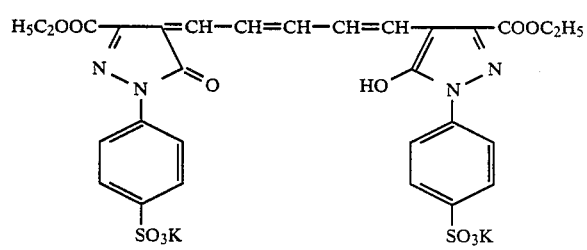

(j) Yellow Coupler:

-continued
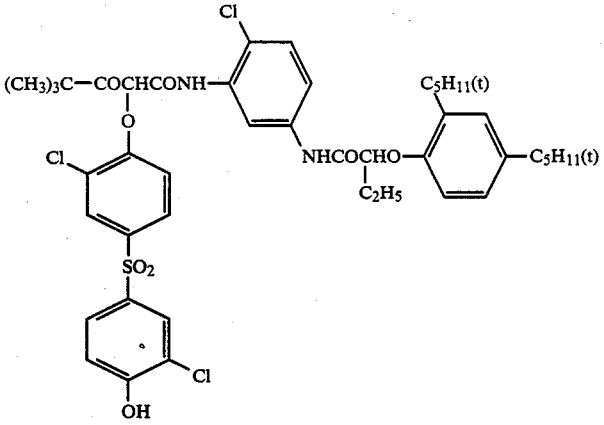
(k) Color Image Stabilizer:
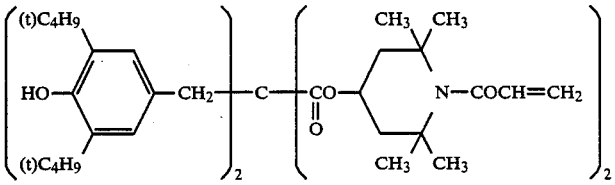
(l) Solvent:
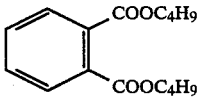
(m) Color Mixing-Preventing Agent:
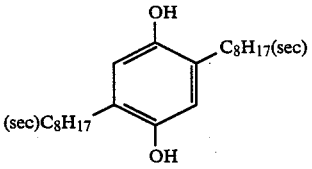
(o) Magenta Coupler:
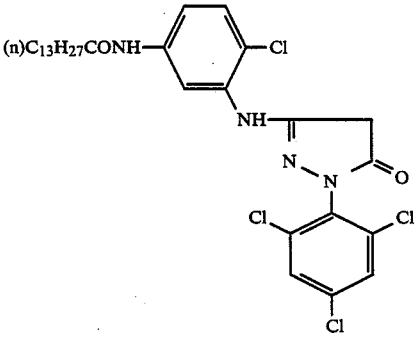
(p) Antifading Agent:

-continued
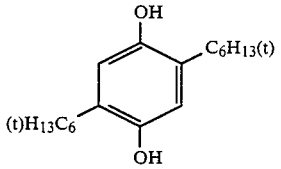
(q) Ultraviolet Ray Absorbent:
A 1:5:3 mixture (molar ratio) of:
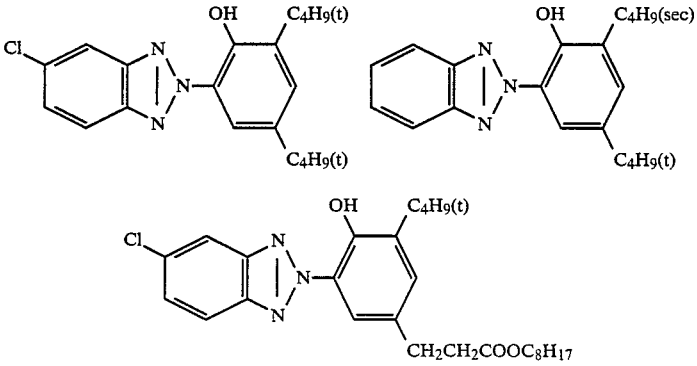
(r) Color-Mixing-Preventing Agent:
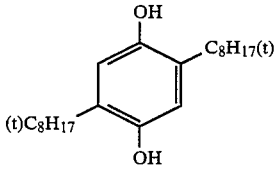
(s) Solvent:
$(isoC_9H_{18}O)_3—P=O$
(t) Cyan Coupler:
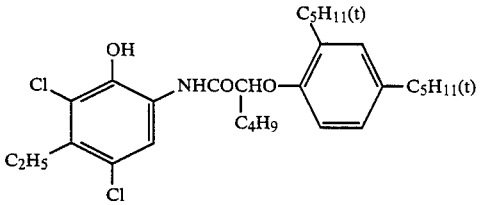
(u) Color Image Stabilizer:
A 1:3:3 mixture (molar ratio) of:
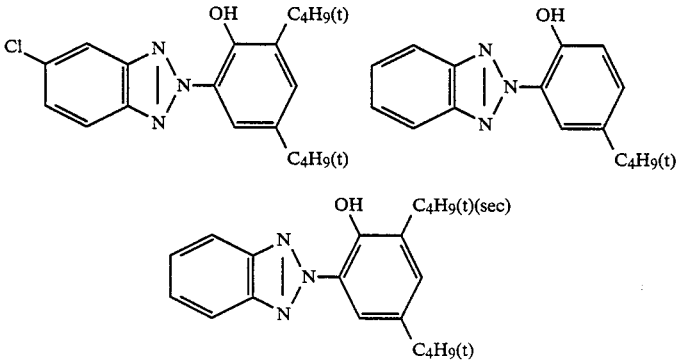

-continued (v) Red-Sensitive Sensitizing Dye:

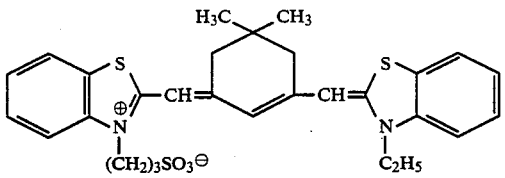

TABLE 11

| Layer | Main Formulation | Amount Used |
|---|---|---|
| 7th Layer (protective layer) | Gelatin | 1.33 g/m$^2$ |
| | Acryl-modified polyvinyl alcohol copolymer (modification degree: 17%) | 0.17 g/m$^2$ |
| 6th Layer (UV ray absorbing layer) | Gelatin | 0.54 g/m$^2$ |
| | UV ray absorbent (q) | 0.21 g/m$^2$ |
| | Solvent (s) | 0.09 cc/m$^2$ |
| 5th Layer (red-sensitive layer) | Silver halide emulsion (see Table 12) Ag: | 0.22 g/m$^2$ |
| | Gelatin | 0.90 g/m$^2$ |
| | Cyan coupler (t) | 0.36 g/m$^2$ |
| | Color image stabilizer (u) | 0.22 cc/m$^2$ |
| 4th Layer (UV ray-absorbing layer) | Gelatin | 1.60 g/m$^2$ |
| | UV ray absorbent (q) | 0.62 g/m$^2$ |
| | Color mixing-preventing agent (r) | 0.05 g/m$^2$ |
| | Solvent (s) | 0.26 cc/m$^2$ |
| 3rd Layer (green-sensitive layer) | Silver halide emulsion layer (see Table 12) Ag: | 0.15 g/m$^2$ |
| | Gelatin | 1.80 g/m$^2$ |
| | Magenta coupler (a) | 0.48 g/m$^2$ |
| | Color image stabilizer (b) | 0.16 g/m$^2$ |
| | Solvent (c) | 0.38 cc/m$^2$ |
| 2nd Layer (color mixing-preventing layer) | Gelatin | 0.99 g/m$^2$ |
| | Color mixing-preventing agent (m) | 0.08 g/m$^2$ |
| 1st Layer (blue-sensitive layer) | Silver halide emulsion layer (see Table 12) Ag: | 0.26 g/m$^2$ |
| | Gelatin | 1.83 g/m$^2$ |
| | Yellow coupler (j) | 0.91 g/m$^2$ |
| | Color image stabilizer (k) | 0.19 g/m$^2$ |
| | Solvent (l) | 0.36 cc/m$^2$ |
| Support | polyethylene-laminated paper (containing white pigment ($TiO_2$) and bluing dye (ultramarine) in polyethylene on the first layer-coated side. | |

*As to combination of silver halide emulsions used in the light-sensitive emulsion layers and combination of additives, see Table 12.

TABLE 12

| Sample | | 1st Layer | 2nd Layer | 3rd Layer | 4th Layer | 5th Layer | 6th Layer | 7th Layer |
|---|---|---|---|---|---|---|---|---|
| | Silver Halide Emulsion | (1) | — | (1) | — | (7) | — | |
| 5-1 | Added Compound(s) (mol/mol Ag) | I-9 ($7.0 \times 10^{-4}$) | — | II-6 ($4.0 \times 10^{-4}$) | — | — | — | |
| | Silver Halide Emulsion | (1) | — | (1) | — | (7) | — | — |
| 5-2 | Added Compound(s) | I-9 ($7.0 \times 10^{-4}$) | — | II-6 ($4.0 \times 10^{-4}$) | — | — | — | — |
| | (mol/mol Ag) | (d) ($5.0 \times 10^{-4}$) | — | (d) ($5.0 \times 10^{-4}$) | — | (d) ($5.0 \times 10^{-4}$) | — | — |
| | Silver Halide Emulsion | (3) | — | (3) | — | (8) | — | — |
| 5-3 | Added Compound(s) (mol/mol Ag) | I-9 ($7.0 \times 10^{-4}$) | — | II-6 ($4.0 \times 10^{-4}$) | — | — | — | — |
| | Silver Halide Emulsion | (3) | — | (3) | — | (8) | — | — |
| 5-4 | Added Compound(s) | I-2 ($7.0 \times 10^{-4}$) | — | II-8 ($3.5 \times 10^{-4}$) | — | — | — | — |
| | (mol/mol Ag) | (d) ($5.0 \times 10^{-4}$) | — | (d) ($5.0 \times 10^{-4}$) | — | (d) ($5.0 \times 10^{-4}$) | — | — |
| | Silver Halide Emulsion | (5) | — | (5) | — | (9) | — | — |
| 5-5 | Added Compound(s) | I-9 ($7.0 \times 10^{-4}$) | — | II-6 ($4.0 \times 10^{-4}$) | — | — | — | — |
| | (mol/mol Ag) | — | — | — | — | — | — | — |
| | Silver Halide Emulsion | (5) | — | (5) | — | (9) | — | — |
| 5-6 | Added Compound(s) | III-18 ($6.0 \times 10^{-4}$) | — | II-19 ($4.0 \times 10^{-4}$) | — | | — | — |
| | (mol/mol Ag) | (d) ($4.0 \times 10^{-4}$) | — | KBr ($3.0 \times 10^{-4}$) | — | KBr ($3.0 \times 10^{-4}$) | — | — |
| | Silver Halide Emulsion | (5) | — | (5) | — | (9) | — | — |
| 5-7 | Added Compound(s) | I-9 ($7.0 \times 10^{-4}$) | — | II-6 ($4.0 \times 10^{-4}$) | — | — | — | — |
| | (mol/mol Ag) | (d) ($5.0 \times 10^{-4}$) | — | (d) ($5.0 \times 10^{-4}$) | — | (d) ($5.0 \times 10^{-4}$) | — | — |

Sample 5-8 was also prepared by changing the formulation of the third layer in Sample 5-7 as shown in Table

TABLE 13

| 3rd Layer of Sample 5-8 | | |
|---|---|---|
| Main Formulation | | Amount Used |
| Silver halide emulsion (5) | Ag: | 0.27 g/m$^2$ |
| Gelatin | | 1.00 g/m$^2$ |
| Magenta Coupler (o) | | 0.31 g/m$^2$ |
| Color image stabilizer (p/b) | | 0.01/0.26 g/m$^2$ |
| Solvent | | 0.32 cc/m$^2$ |

TABLE 14

| Sample 5-9 | 1st Layer | 3rd Layer | 5th Layer |
|---|---|---|---|
| Amount used | 0.35 g/m$^2$ | 0.20 g/m$^2$ | 0.30 g/m$^2$ |

AgX (as Ag)

These samples were subjected to the same test as i Example 1.

The results thus obtained are shown in Table 15. Exposure was conducted as follows. Gradation for sensitometry was imparted through a blue light filter, a green light filter, or a red light filter made by Fuji Photo Film Co., Ltd. using a sensitometer. The exposure was conducted so that 0.5-second exposure gave an exposure amount of 250 CMS as in Example 1.

The relative sensitivities shown in Table 15 were evaluated as a relative value of a reciprocal of an exposure amount necessary for providing a density of fog+0.5, using the result of development for 3 minutes and 30 seconds according to processing A as a standard.

TABLE 15

| | | Processing A | | | | Processing B | | | | |
|---|---|---|---|---|---|---|---|---|---|---|
| Sample No. | Layer | Development Time | Dmin | Relative Sensitivity | Color Forming Property | Development Time | Dmin | Relative Sensitivity | Color Forming Property | Coated Silver Amount |
| | B | 3 min 30 sec | 0.08 | 100 | 1.50 | 30 sec | 0.08 | 68 | 0.77 | |
| | | | | | | 60 sec | 0.08 | 93 | 1.22 | |
| 5-1 | G | 3 min 30 sec | 0.10 | 100 | 1.50 | 30 sec | 0.10 | 93 | 1.39 | 0.63 |
| | | | | | | 60 sec | 0.10 | 102 | 1.49 | g/m |
| | R | 3 min 30 sec | 0.11 | 100 | 1.50 | 30 sec | 0.11 | 83 | 1.34 | |
| | | | | | | 60 sec | 0.11 | 93 | 1.43 | |
| | B | 3 min 30 sec | 0.08 | 100 | 1.50 | 30 sec | 0.08 | 62 | 0.68 | |
| | | | | | | 60 sec | 0.08 | 85 | 1.11 | |
| 5-2 | G | 3 min 30 sec | 0.09 | 100 | 1.50 | 30 sec | 0.09 | 89 | 1.39 | 0.63 |
| | | | | | | 60 sec | 0.09 | 98 | 1.47 | g/m |
| | R | 3 min 30 sec | 0.10 | 100 | 1.50 | 30 sec | 0.10 | 79 | 1.25 | |
| | | | | | | 60 sec | 0.10 | 85 | 1.33 | |
| | B | 3 min 30 sec | 0.08 | 100 | 1.50 | 30 sec | 0.08 | 79 | 1.26 | |
| | | | | | | 60 sec | 0.09 | 123 | 1.59 | |
| 5-3 | G | 3 min 30 sec | 0.10 | 100 | 1.50 | 30 sec | 0.10 | 95 | 1.37 | 0.63 |
| | | | | | | 60 sec | 0.11 | 112 | 1.53 | g/m |
| | R | 3 min 30 sec | 0.11 | 100 | 1.50 | 30 sec | 0.11 | 95 | 1.37 | |
| | | | | | | 60 sec | 0.12 | 110 | 1.59 | |
| | B | 3 min 30 sec | 0.08 | 100 | 1.50 | 30 sec | 0.07 | 79 | 1.23 | |
| | | | | | | 60 sec | 0.07 | 115 | 1.60 | |
| 5-4 | G | 3 min 30 sec | 0.09 | 100 | 1.50 | 30 sec | 0.09 | 102 | 1.40 | 0.63 |
| | | | | | | 60 sec | 0.09 | 120 | 1.62 | g/m |
| | R | 3 min 30 sec | 0.10 | 100 | 1.50 | 30 sec | 0.10 | 100 | 1.40 | |
| | | | | | | 60 sec | 0.10 | 112 | 1.57 | |
| | B | 3 min 30 sec | 0.08 | 100 | 1.50 | 30 sec | 0.09 | 95 | 1.52 | |
| | | | | | | 60 sec | 0.14 | 115 | 1.68 | |
| 5-5 | G | 3 min 30 sec | 0.10 | 100 | 1.50 | 30 sec | 0.10 | 100 | 1.53 | 0.63 |
| | | | | | | 60 sec | 0.15 | 112 | 1.65 | g/m |
| | R | 3 min 30 sec | 0.11 | 100 | 1.50 | 30 sec | 0.12 | 102 | 1.49 | |
| | | | | | | 60 sec | 0.14 | 117 | 1.72 | |
| | B | 3 min 30 sec | 0.07 | 100 | 1.50 | 30 sec | 0.07 | 93 | 1.50 | |
| | | | | | | 60 sec | 0.07 | 115 | 1.63 | |
| 5-6 | G | 3 min 30 sec | 0.10 | 100 | 1.50 | 30 sec | 0.10 | 120 | 1.60 | 0.63 |
| | | | | | | 60 sec | 0.11 | 125 | 1.65 | g/m |
| | R | 3 min 30 sec | 0.10 | 100 | 1.50 | 30 sec | 0.10 | 112 | 1.60 | |
| | | | | | | 60 sec | 0.12 | 123 | 1.75 | |
| | B | 3 min 30 sec | 0.07 | 100 | 1.50 | 30 sec | 0.07 | 105 | 1.52 | |
| | | | | | | 60 sec | 0.07 | 123 | 1.65 | |
| 5-7 | G | 3 min 30 sec | 0.10 | 100 | 1.50 | 30 sec | 0.09 | 115 | 1.55 | 0.63 |
| | | | | | | 60 sec | 0.09 | 123 | 1.65 | g/m |
| | R | 3 min 30 sec | 0.10 | 100 | 1.50 | 30 sec | 0.10 | 115 | 1.62 | |
| | | | | | | 60 sec | 0.10 | 126 | 1.78 | |
| | B | 3 min 30 sec | 0.07 | 100 | 1.50 | 30 sec | 0.07 | 102 | 1.52 | |
| | | | | | | 60 sec | 0.07 | 120 | 1.65 | |
| 5-8 | G | 3 min 30 sec | 0.10 | 100 | 1.50 | 30 sec | 0.09 | 102 | 1.47 | 0.75 |
| | | | | | | 60 sec | 0.10 | 115 | 1.67 | g/m |
| | R | 3 min 30 sec | 0.11 | 100 | 1.50 | 30 sec | 0.11 | 115 | 1.62 | |
| | | | | | | 60 sec | 0.11 | 126 | 1.79 | |
| | B | 3 min 30 sec | 0.08 | 100 | 1.50 | 30 sec | 0.08 | 76 | 1.22 | |
| | | | | | | 60 sec | 0.09 | 110 | 1.60 | |
| 5-9 | G | 3 min 30 sec | 0.10 | 100 | 1.50 | 30 sec | 0.09 | 79 | 1.46 | 0.85 |
| | | | | | | 60 sec | 0.10 | 107 | 1.63 | g/m |
| | R | 3 min 30 sec | 0.11 | 100 | 1.50 | 30 sec | 0.11 | 83 | 1.50 | |
| | | | | | | 60 sec | 0.11 | 107 | 1.71 | |

As is apparent from the results shown in Table 15, the present invention enables one to obtain a multi-layered color print having high sensitivity, suffering less fog formation, and showing excellent color-forming properties even by rapid processing using a benzyl alcohol-free color developer.

Particularly, as can be seen from the comparison of Samples 5-7 and 5-8 with 5-9, the effects of the present invention are particularly remarkable when the amount of coated silver is not more than 0.78 g/m$^2$. This remarkable effect is also apparent with respect to silver removability. That is, as a result of comparing the results of samples processed according to processing B with the results of samples subjected to 30-second bleach-fixing processing according to processing B as in Example 1, it was found that the samples of the present invention cause no problems with respect to silver removability, whereas Sample 5-9 which contained a large amount of coated silver showed unfavorable results. Part of the results are shown in Table 16.

TABLE 16

| Layer | Bleach-fixing Time | Silver Removability Sample 5-7 | Sample 5-8 | Sample 5-9 |
|---|---|---|---|---|
| B | 45 sec | 4 | 3 | 2 |
| G | 45 sec | 4 | 4 | 3 |
| R | 45 sec | 4 | 4 | 4 |

According to the present invention, high colorforming properties and high spectral sensitization ratios can be obtained with a low degree of fog formation (Dmin) even when rapid development, i.e., not longer than about 2 minutes and 30 seconds, is conducted using a substantially benzyl alcohol-free color developer, by incorporating the spectral sensitizing dyes represented by general formula (I), (II) or (III) into a high silver chloride emulsion.

High silver chloride emulsions associated with suitable spectral sensitizing dyes, from which silver is difficult to remove, can be rapidly processed by using a processing solution of not more than pH 6.5 having a bleaching ability.

In addition, substantial elimination of benzyl alcohol from color developer serves to remarkably reduce the amount of environmental pollution, reduce solution-preparing work, and remove reduction of density due to cyan dye staying in the leuco form. The color developer has such an excellent storage stability that no tar is formed even after long-time storage.

While the invention has been described in detail and with reference to specific embodiments thereof, it will be apparent to one skilled in the art that various changes and modifications can be made therein without departing from the spirit and scope thereof.

What is claimed is:

1. A color image-forming process which comprises image-wise exposing a silver halide color photographic material, processing said photographic material with a color developer, then processing said photographic material with a solution having a pH of not more than about 6.5 and having a bleaching ability within about 75 seconds, said photographic material comprising a reflective support having thereon a blue-sensitive silver halide emulsion layer containing a yellow dye-forming coupler, a green-sensitive silver halide emulsion layer containing a magenta dye-forming coupler and a red-sensitive silver halide emulsion layer containing a cyan dye-forming coupler, the total silver amount of said silver halide on said reflective support being up to about 0.78 g/m$^2$, and at least one of said emulsion layers comprising a silver halide emulsion substantially excluding silver iodide and comprising about 80 mol % or more silver chloride and containing a spectral sensitizing dye represented by the following general formula (I), (II) or (III):

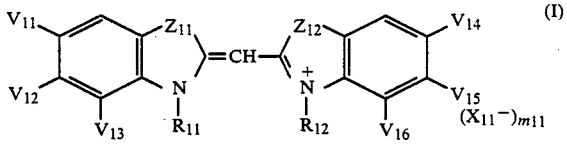

(I)

wherein:

$Z_{11}$ represents an oxygen atom, a sulfur atom or a selenium atom;

$Z_{12}$ represents a sulfur atom or a selenium atom;

$R_{11}$ and $R_{12}$, which may be the same or different, each represents an optionally substituted alkyl group or alkenyl group containing up to 6 carbon atoms, with at least one of $R_{11}$ and $R_{12}$ being a sulfo-substituted alkyl group;

when $Z_{11}$ represents an oxygen atom, $V_{11}$ and $C_{13}$ each represents a hydrogen atom, and $V_{12}$ represents an optionally substituted phenyl group, or $V_{11}$ and $V_{12}$, or $V_{12}$ and $V_{13}$, may be linked to each other to form a fused benzene ring;

when $Z_{11}$ represents a sulfur atom or a selenium atom, $V_{11}$ represents an alkyl group containing up to 4 carbon atoms, an alkoxy group containing up to 4 carbon atoms or a hydrogen atom, $V_{12}$ represents an alkyl group containing up to 5 carbon atoms, an alkoxy group containing up to 4 carbon atoms, a chlorine atom, a hydrogen atom, an optionally substituted phenyl group or a hydroxy group, and $V_{13}$ represents a hydrogen atom, or $V_{11}$ and $V_{12}$, or $V_{12}$ and $V_{13}$, may be linked to each other to form a fused benzene ring;

when $Z_{12}$ represents a selenium atom, $V_{14}$, $V_{15}$, and $V_{16}$ are respectively the same as defined for $V_{11}$, $V_{12}$, and $V_{13}$ in connection with the case where $Z_{11}$ represents a selenium atom;

when $Z_{12}$ represents a sulfur atom and $Z_{11}$ represents a selenium atom, $V_{14}$ represents a hydrogen atom, an alkoxy group containing up to 4 carbon atoms or an alkyl group containing up to 5 carbon atoms, $V_{15}$ represents an alkoxy group containing up to 4 carbon atoms, an optionally substituted phenyl group, an alkyl group containing up to 4 carbon atoms, a chlorine atom or a hydroxy group, and $V_{16}$ represents a hydrogen atom, or $V_{14}$ and $V_{15}$, or $V_{15}$ and $V_{16}$, m ay be linked to each other to form a fused benzene ring;

when $Z_{11}$ and $Z_{12}$ both represent a sulfur atom, $V_{14}$ and $V_{16}$ each represents a hydrogen atom, and $V_{15}$ represents an optionally substituted phenyl group, or $V_{14}$ and $V_{15}$, or $V_{15}$ and $V_{16}$, may be linked to each other to form a ring;

when $Z_{11}$ represents an oxygen atom and $z_{12}$ represents a sulfur atom, $V_{14}$ and $V_{16}$ each represents a hydrogen atom, and $V_{15}$ represents a chlorine atom, an optionally substituted phenyl group or an alkoxy group containing up to 4 carbon atoms, or $V_{15}$ and $V_{16}$ may be linked to each other to form a fused benzene ring;

$X_{11}$ represents a counter ion which is required to neutralize a charge on a cyanine dye of formula (I) or (II); and $m_{11}$ represents 0 or 1;

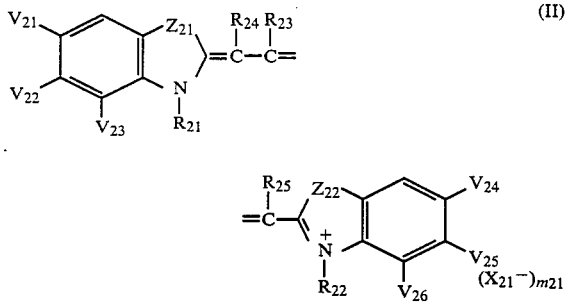

(II)

wherein:

$Z_{21}$ represents an oxygen atom, a sulfur atom, a selenium atom, or $>N-R_{26}$;

$Z_{22}$ represents an oxygen atom or $>N-R_{27}$;

$R_{21}$ and $R_{22}$ are the same as defined for $R_{11}$ or $R_{12}$ in general formula (I), or $R_{21}$ and $R_{24}$, or $R_{22}$ and $R_{25}$, may be linked to each other to form a 5- or 6-membered carbon ring;

$R_{23}$ represents a hydrogen atom when at least one of $z_{21}$ and $Z_{22}$ represents $>N-R_{26}$, or represents an ethyl group, a propyl group or a butyl group in other cases;

$R_{26}$ and $R_{27}$ are the same as defined for $R_{11}$ in general formula (I), provided that $R_{21}$ and $R_{26}$, and $R_{22}$ and $R_{27}$, do not represent a sulfo group-containing substituent at the same time;

$R_{24}$ and $R_{25}$ each represents a hydrogen atom;

$V_{21}$ represents a hydrogen atom when $Z_{21}$ represents an oxygen atom, or represents a hydrogen atom, an alkyl group containing up to 5 carbon atoms or an alkoxy group containing up to 5 carbon atoms when $Z_{21}$ represents a sulfur atom or a selenium atom, or represents a hydrogen atom or a chlorine atom when $Z_{21}$ represents $>N-R_{26}$;

$V_{22}$ represents a hydrogen atom, an alkyl group containing up to 5 carbon atoms, an alkoxy group containing up to 5 carbon atoms, a chlorine atom or an optionally substituted phenyl group, or $V_{22}$ may be bonded to $V_{21}$ or $V_{23}$ to form a fused benzene ring when $Z_{21}$ represents an oxygen atom and $Z_{22}$ represents $>N-R_{27}$, or $V_{22}$ represents an optionally substituted phenyl group or may be bonded to $V_{21}$ or $V_{23}$ to form a fused benzene ring when $Z_{21}$ and $Z_{22}$ both represent an oxygen atom, or $V_{22}$ represents a hydrogen atom, an alkyl group containing up to 5 carbon atoms, an alkoxycarbonyl group containing up to 5 carbon atoms, an alkoxy group containing up to 4 carbon atoms, an acylamino group containing up to 4 carbon atoms, a chlorine atom, or an optionally substituted phenyl group when $Z_{21}$ represents a sulfur atom or a selenium atom, or may be bonded to $V_{23}$ to form a fused benzene ring when $Z_{21}$ represents a sulfur atom, or represents a chlorine atom, a trifluoromethyl group, a cyano group, an alkylsulfonyl group containing up to 4 carbon atoms or an alkoxycarbonyl group containing up to 5 carbon atoms when $Z_{21}$ represents $>N-R_{26}$;

$V_{24}$ represents a hydrogen atom when $Z_{22}$ represents an oxygen atom, or represents a hydrogen atom or a chlorine atom when $Z_{22}$ represents $>N-R_{27}$;

$V_{25}$ represents an alkoxy group containing up to 4 carbon atoms, a chlorine atom or an optionally substituted phenyl group or may be bonded to $V_{24}$ or $V_{26}$ to form a fused benzene ring when $Z_{22}$ represents an oxygen atom, or is bonded to $V_{24}$ or $V_{26}$ to form a fused benzene ring when $Z_{21}$ represents $>N-R_{26}$, an oxygen atom, a sulfur atom or a selenium atom, or, when $Z_{22}$ represents $>N-R_{27}$, $V_{25}$ represents a chlorine atom, a trifluoromethyl group, a cyano group, an alkylsulfonyl group containing up to 4 carbon atoms or a carboxyalkyl group containing up to 5 carbon atoms;

$V_{26}$ represents a hydrogen atom;

$X_{21}$ represents a counter ion which is required to neutralize a charge on a cyanine dye of formula (I) or (II); and $m_{21}$ represents 0 or 1;

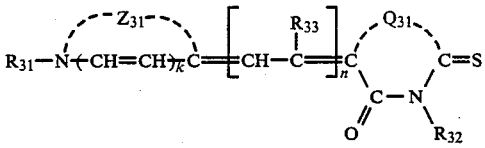

(III)

wherein:

$Z_{31}$ represents atoms forming a heterocyclic nucleus of thiazoline, thiazole, benzothiazole, naphthothiazole, selenazoline, selenazole, benzoselenazole, naphthoselenazole, benzimidazole, naphthoimidazole, oxazole, benzoxazole, zole, selenazoline, selenazole, benzoselenazole, naphthoselenazole, benzimidazole, naphthoimidazole, oxazole, benzoxazole, naphthoxazole or pyridine, with the heterocyclic nucleus being optionally substituted;

when $Z_{31}$ represents atoms forming a benzimidozole nucleus, one or more substituents in the fused benzene ring are selected from among a chloride atom, a cyano group, an alkoxycarbonyl group containing up to 5 carbon atoms, an alkylsulfonyl group containing up to 4 carbon atoms, and a trifluoromethyl group;

when $Z_{31}$ represents atoms forming heterocyclic nuclei other than benzimidozole, thiazoline and selenazoline, one or more substituents in the fused benzene ring or naphthalene ring are selected from among an alkyl group containing up to 8 carbon atoms, a hydroxy group, an alkoxycarbonyl group containing up to 5 carbon atoms, a halogen atom, a carboxy group, a furyl group, a thienyl group, a pyridyl group, a phenyl group and a substituted phenyl group;

when $Z_{31}$ represents atoms forming a selenazoline or thiazoline nucleus, one or more substituents in the nucleus is selected from among an alkyl group containing up to 6 carbon atoms, a hydroxyalkyl group containing up to 5 carbon atoms and an alkoxycarbonylalkyl group containing up to 5 carbon atoms;

$R_{31}$ is the same as defined for $R_{11}$ or $R_{12}$ in general formula (I);

$R_{32}$ is the same as defined for $R_{11}$ or $R_{12}$ in general formula (I) or represents a hydrogen atom, a furfuryl group or an optionally substituted aryl group, provided that at least one of $R_{31}$ and $R_{32}$ represents a substituent having a sulfo or carboxy group and the other represents a substituent having no sulfo group;

$R_{33}$ represents a hydrogen atom, an alkyl group containing up to 5 carbon atoms, a phenethyl group, a phenyl group or a 2-carboxyphenyl group;

$Q_{31}$ represents an oxygen atom, a sulfur atom, a selenium atom or

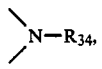

provided that, when $Z_{31}$ represents atoms forming a thiazoline, selenazoline or oxazole nucleus, $Q_{31}$ represents a sulfur atom, a selenium atom or

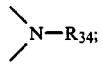

$R_{34}$ represents a hydrogen atom, a pyridyl group, a phenyl group, a substituted phenyl group, or an aliphatic hydrocarbyl group optionally containing an oxygen atom, a sulfur atom or a nitrogen atom in the carbon chain, optionally having a substituent or substituents, and containing a total of up to 8 carbon atoms;

k represents 0 or 1; and n represents 0 or 1 provided that, when n represents 1 and $Z_{31}$ represents atoms forming a pyridine nucleus, $Q_{31}$ represents an oxygen atom.

2. The color image-forming process as claimed in claim 1, wherein said color developer contains up to about 0.002 mol/liter of bromide ion.

3. The color image-forming process as claimed in claim 1, wherein said processing with a color developer is conducted within about 2 minutes and 30 seconds, said color developer substantially excluding benzyl alcohol.

4. The color image-forming process as claimed in claim 1, wherein said solution having a bleaching ability is a bleach-fixing solution.

5. The color image-forming process as claimed in claim 1, wherein said silver halide substantially excludes silver iodide and comprises 90 mol% or more silver chloride.

6. The color image-forming process as claimed in claim 1, wherein said processing with said solution having a bleaching ability occurs within 60 seconds, and said solution has a pH of not more than 6.0.

7. The color image-forming process as claimed in claim 1, wherein said processing with a color developer is conducted within 10 seconds to two minutes.

8. The color image-forming process as claimed in claim 1, wherein said photographic material undergoes water-washing processing after said processing with a solution having a bleaching ability.

9. The color image-forming process as claimed in claim 5, wherein a silver halide comprises 95 mol % or more of a silver chloride.

10. The color image-forming process as claimed in claim 3, wherein a concentration of a benzyl alcohol is not more than 0.5 ml/l.

11. The color image-forming process as claimed in claim 10, wherein a color developer contains no benzyl alcohol at all.

12. The color image-forming process as claimed in claim 2, wherein a color developer contains not more than 0.0007 mol/l of a bromine ion.

13. The color image-forming process as claimed in claim 12, wherein a color developer contains no bromine ion at all.

14. The color image-forming process as claimed in claim 1, wherein a silver halide emulsion is a monodispersed emulsion having not more than 0.15 of a degree of monodispersion (s/d).

15. The color image-forming process as claimed in claim 1, wherein an aromatic primary amine developer is of p-phenylenediamine derivatives.

16. The color image-forming process as claimed in claim 15, wherein an aromatic primary amine is selected from the group consisting of: N,N-diethyl-p-phenylenediamine, 2-amino-5-diethylaminotoluene, 2-amino-5-(N-ethyl-N-laurylamino)toluene, 4-[N-ethyl-N-(β-hydroxyethyl)amino]aniline, 2-methyl-4-[N-ethyl-N-(β-hydroxyethyl)amino]aniline, N-ethyl-N-(β-methanesulfonamidoethyl)-3-methyl-4-aminoaniline, N-(2-amino-5-diethylaminophenylethyl)methanesulfonamide, N,N-dimethyl-p-phenylenediamine, 4-amino-3-methyl-N-ethyl-N-methoxyethylaniline, 4-amino-3-methyl-N-ethyl-N-β-ethoxyethylaniline, and 4-amino-3-methyl-N-ethyl-N-β-butoxyethylaniline, and salts of said compounds.

17. The color image-forming process as claimed in claim 16, wherein said p-phenylenediamine derivative is N-ethyl-N-(β-methanesulfonamidoethyl)-3-methyl-4-aminoaniline or salt thereof.

18. The color image-forming process as claimed in claim 1, wherein a color developer contains a luminescent brightening agent.

19. The color image-forming process as claimed in claim 18, wherein a luminescent whitening agent is of 4,4-diamino-2,2'-disulfrostilben type.

20. The color image-forming process as claimed in claim 1, wherein a treating solution having bleaching activity is a ferric ion complex as a bleaching agent.

21. The color image-forming process as claimed in claim 20, wherein a ferric ion complex is a complex of a ferric ion and an amino polycarboxylic acid, amino polysulfonic acid, or each salt thereof.

* * * * *